US008261924B2

(12) United States Patent
Karpisek

(10) Patent No.: US 8,261,924 B2
(45) Date of Patent: Sep. 11, 2012

(54) FOLDING CONTAINERS

(75) Inventor: Ladislav Stephan Karpisek, Caringbah (AU)

(73) Assignee: Technosearch Pty Ltd, Caringbah (AU)

( * ) Notice: Subject to any disclaimer, the term of this patent is extended or adjusted under 35 U.S.C. 154(b) by 270 days.

(21) Appl. No.: 12/725,327

(22) Filed: Mar. 16, 2010

(65) Prior Publication Data

US 2010/0187228 A1 Jul. 29, 2010

Related U.S. Application Data

(63) Continuation-in-part of application No. PCT/AU2008/000859, filed on Jun. 13, 2008.

(30) Foreign Application Priority Data

Sep. 17, 2007 (AU) ..... 2007905062
Nov. 25, 2009 (AU) ..... 2009905773

(51) Int. Cl.
*B65D 6/18* (2006.01)

(52) U.S. Cl. ..... 220/6; 220/4.28; 220/1.5

(58) Field of Classification Search ..... 220/1.5, 220/6, 4.28, 811, 812; 52/79.5
See application file for complete search history.

(56) References Cited

U.S. PATENT DOCUMENTS 3,618,803 A 11/1971 Dobberkau et al.
3,746,203 A 7/1973 Cipolla
3,972,437 A * 8/1976 Lovich et al. ..... 220/1.5
4,603,787 A * 8/1986 Essary ..... 220/1.5
5,862,931 A 1/1999 Cox et al.
5,890,612 A * 4/1999 Coppi ..... 220/7
5,941,405 A * 8/1999 Scales et al. ..... 220/1.5
6,401,953 B2 6/2002 Kofod
6,422,409 B2 7/2002 Kofod
7,347,340 B2 3/2008 Carola
2002/0179598 A1 * 12/2002 Kuhn ..... 220/1.5

FOREIGN PATENT DOCUMENTS

GB 1025888 4/1966
GB 2351068 12/2000

* cited by examiner

*Primary Examiner* — Stephen Castellano

(74) *Attorney, Agent, or Firm* — Carol L. Francis; Bozicevic, Field & Francis LLP

(57) ABSTRACT

A collapsible air freight container (10) comprises a standard base (12), a side panel (16) slideably hinged to the base and a back panel (18) which is hinged to the base which interlocks with the side panel. There is a side extension (20) which is generally trapezoidal to roughly conform to the shape of a side wall of a plane's cargo hold. A lid is slideably mounted on top of the container so that it can be slid relative to the back panel. The lid is arranged so that when fully retracted to the back of the container relative to the back panel, it may pivot to overlay the back panel. The container may be collapsed by retracting and pivoting the lid to overlie the back panel (18), folding the side extension (20), folding and sliding the side panel (16) into the base (12) and lowering the folded side extension (20) and then the back panel (18) and lid (40) into the base.

18 Claims, 31 Drawing Sheets

FOLDING CONTAINERS

CROSS REFERENCE TO RELATED APPLICATIONS

This application is a continuation in part of PCT/AU2008/000859 filed on 13 Jun. 2008 (published as WO 2009/036484) which claims priority benefit of Australian Provisional Patent Application No. 2007905062 entitled "Improvement in folding container" filed 17 Sep. 2007, the entire contents of all of which are incorporated herein by reference. This application also claims priority benefit of Australian Provisional Patent Application No. 2009905773 entitled "Improvement in folding container" filed 25 Nov. 2009, the entire contents of which are also incorporated herein by reference.

FIELD OF THE INVENTION

This invention relates to improvements in folding containers. In particular, it relates to improvements in containers for air transport.

BACKGROUND OF THE INVENTION

Air freight containers are used store and transport freight such as packages, perishable goods, mail and the like for loading onto cargo and passenger planes. Such containers are pre-loaded with cargo and subsequently loaded onto aircraft to reduce the time it takes to load the aircraft and to ensure that all available space in the aircraft is utilised. Air freight containers also protect the cargo from rain and snow during the aircraft loading process.

There is limited space available in aircraft and air freight containers are typically shaped to make the most of the available space. One of the most common type of air freight containers is in the shape of a cube with a trapezoidal extension at one end to generally conform to the shape of the curved side walls of an aircraft's cargo hold. Such air freight containers are also known as "unit load devices". Such containers have been used by the airline industry for about thirty years.

One problem with the use of air freight containers is imbalance, which occurs when there are too many containers at one airport and not enough at another. To correct these imbalances, surplus empty containers have to be shipped to their desired location, which is wasteful and costly particularly when an entire aircraft is filled with empty containers for shipping from one continent to another.

A further problem is maintenance. Air freight containers are light, typically weighing about 80 Kg. Because they are lightly built, they are easily damaged and often have to be taken out of service for repair, typically at least twice a year.

There have been a small number of proposals for collapsible air freight containers. U.S. Pat. No. 5,941,405 proposes one such collapsible container. The proposed container has an aluminium base and top but collapsible fabric side walls. However it is likely that the collapsible container of U.S. Pat. No. 5,941,405 having fabric side walls would not be sufficiently strong for practical commercial use. U.S. Pat. No. 6,299,009 also discloses a proposed design of collapsible air freight container but which, when collapsed, is not particularly compact.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

A first broad aspect of the present invention provides a collapsible air freight container having rigid walls a base and a lid and a side extension assembly in which when collapsed, the components all locate on top of the base in a compact manner.

More particularly in one aspect the invention provides a collapsible folding freight container for air transport, having an erected state and a collapsed or folded state, the container comprising:

a base;

a side panel mounted to the base such the side panel may be folded over the base;

an end panel mounted to the base such the end panel may be folded over the base;

a side extension assembly including a frame and a collapsible side extension, the side extension having an erected configuration and a collapsed configuration and wherein in the collapsed configuration the side extension and frame may be folded over the base; and a lid slideably mounted between two of the frame, the side panel and the end panel and being pivotable relative to the other of the two panels or frame, wherein when the end panel is folded over the base the lid locates above the other of the two panels or the frame.

In a preferred embodiment the side extension includes:

a pair of end panels which are pivotally mounted to opposed vertical sides of the frame;

a side extension lid; and side extension panels which are mounted to lower horizontal members of the frame and/or the side extension lid and/or each other.

Typically, the side extension lid is hinged to the upper member of the frame, a first upper side extension panel, which is generally vertical in use when the container is erected, is hinged to the side extension lid, and a sloping side wall panel, which is oriented at an angle between vertical and horizontal in use when the container is erected, is hinged to the lower horizontal member of the frame, and a side wall extension panel is hinged to the sloping side wall panel.

Preferably, in the collapsed configuration, any side extension components all locate inside the frame.

It is preferred that the side extension is generally trapezoidal in cross-section.

In a preferred aspect, the end panels of the side extension define L shaped edges for supporting edges of the side panels.

In a preferred embodiment, the lid is slideably mounted between the frame and the side panel and is pivotable relative to the back panel, wherein when the end panel is folded over the base, the lid locates directly above the back panel.

In one embodiment, he base may define upstanding corner posts.

In other embodiments, the corner posts may be omitted.

Typically, the side panel is mounted to the base by means of slideable hinges and can be lowered onto the upper surface of the base.

When collapsing the container, the side wall may be lowered onto the base, the collapsed frame and side extension assembly may locate on top of the side wall, the back wall may locate on top of the side extension and frame and the lid may locate on top of the back wall.

In those embodiments which include corners posts, in the collapsed state, the lid lies preferably below the top of the corner posts to improve the stacking characteristics of the collapsed container.

In one preferred aspect, a pair of spigots depend from the lid and slideably locate in channels defined near a top edge of the side panel and frame respectively and wherein a pair of recesses are defined in the top of the back panel which when the container is in the erected state are aligned with one of the channels to allow the spigots to be slid along the channels and into the recesses.

In a related aspect the invention provides a collapsible folding freight container for air transport, having an erected state and a collapsed or folded state, the container comprising:

a base;

a side panel mounted to the base;

an end panel mounted to the base;

a side extension assembly including a frame and a collapsible side extension, the side extension having an erected configuration and a collapsed configuration and wherein in the collapsed configuration the side extension and frame may be folded over the base; and a lid which in the erected state locates on an may be supported by the side panel, end panel and the frame; and wherein the side extension assembly further comprises;

a pair of end panels which are pivotally mounted to opposed vertical sides of the frame;

a side extension lid; and side extension panels which are mounted to lower horizontal members of the frame and/or the side extension lid and/or each other, the arrangement being such that in the collapsed state the end panels and side extension lid and panels locate within the frame.

In a particularly advantageous aspect, the present invention provides a container which can be folded to take up the minimum amount of space for shipping or storage. The container most preferably weighs about the same as or less than existing unit load devices, about 80 Kg, and is constructed so that damaged parts can be replaced relatively easily without taking the container out of service.

In a further related aspect, there is provided a collapsible folding freight container for air transport, having an erected state and a collapsed or folded state, the container comprising:

a base;

a side panel mounted to the base such the side panel may be folded over the base;

an end panel mounted to the base such the end panel may be folded over the base;

a side extension assembly including a frame and a collapsible side extension, the side extension having an erected configuration and a collapsed configuration and wherein in the collapsed configuration the side extension and frame may be folded over the base, the side extension including a lid panel;

a lid slidably mounted between two of the frame, the side panel and the end panel and being pivotable relative to the other of the two panels or frame, wherein when the end panel is folded over the base the lid locates above the other of the two panels or the frame; and wherein the lid and the lid panel of the side extension assembly are configured such that the side extension lid panel may be retracted or slid into the lid.

DETAILED DESCRIPTION OF PREFERRED EMBODIMENTS

Preferred embodiments of the invention will now be described, by way of example only, and with reference to the accompanying drawings in which.

DETAILED DESCRIPTION OF PREFERRED EMBODIMENTS

Figure 9:
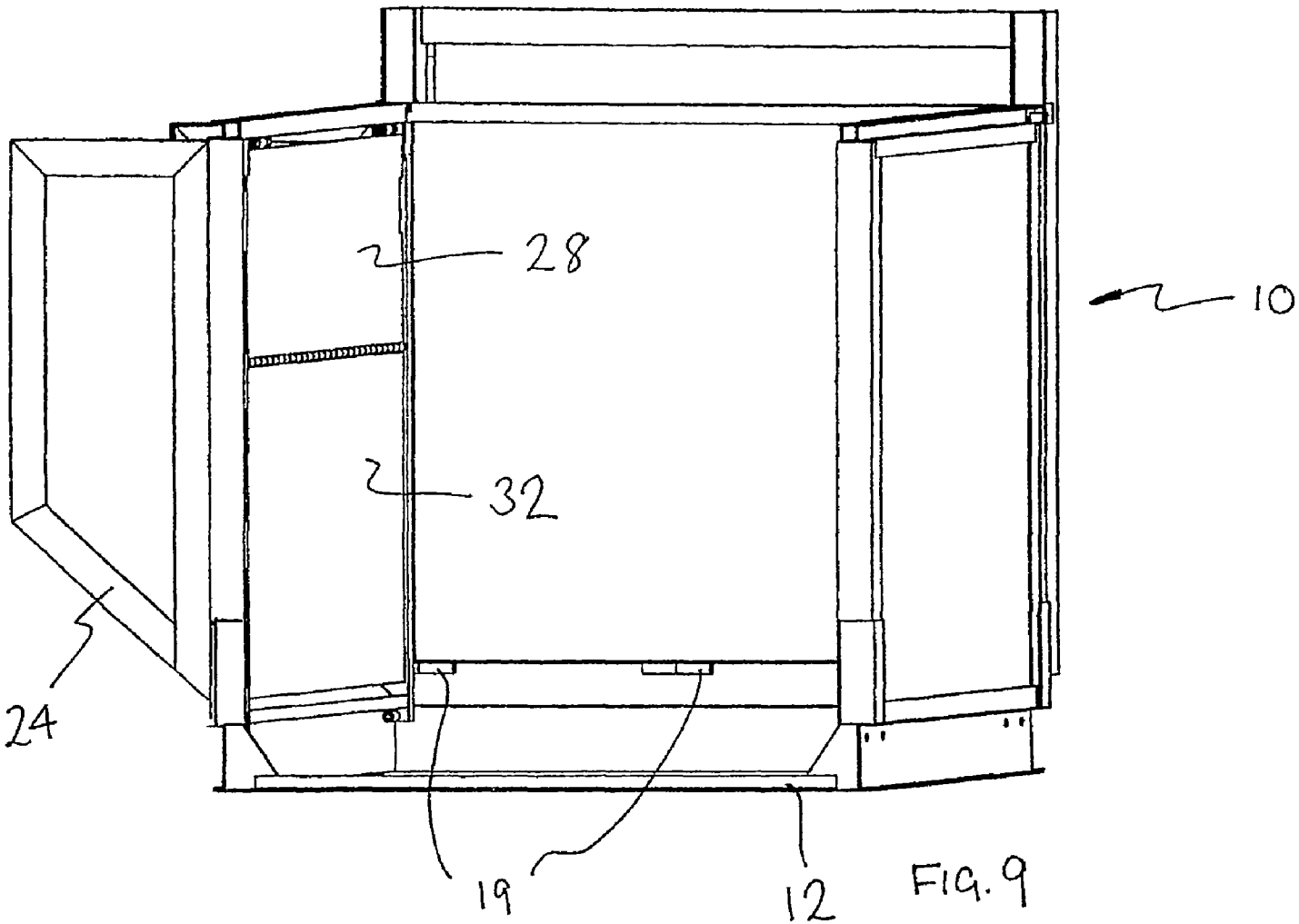
FIG. 9 is an isometric view illustrating a further stage in the folding of the container shown in FIG. 8 being the start of the folding of a side extension.
Figure 15:
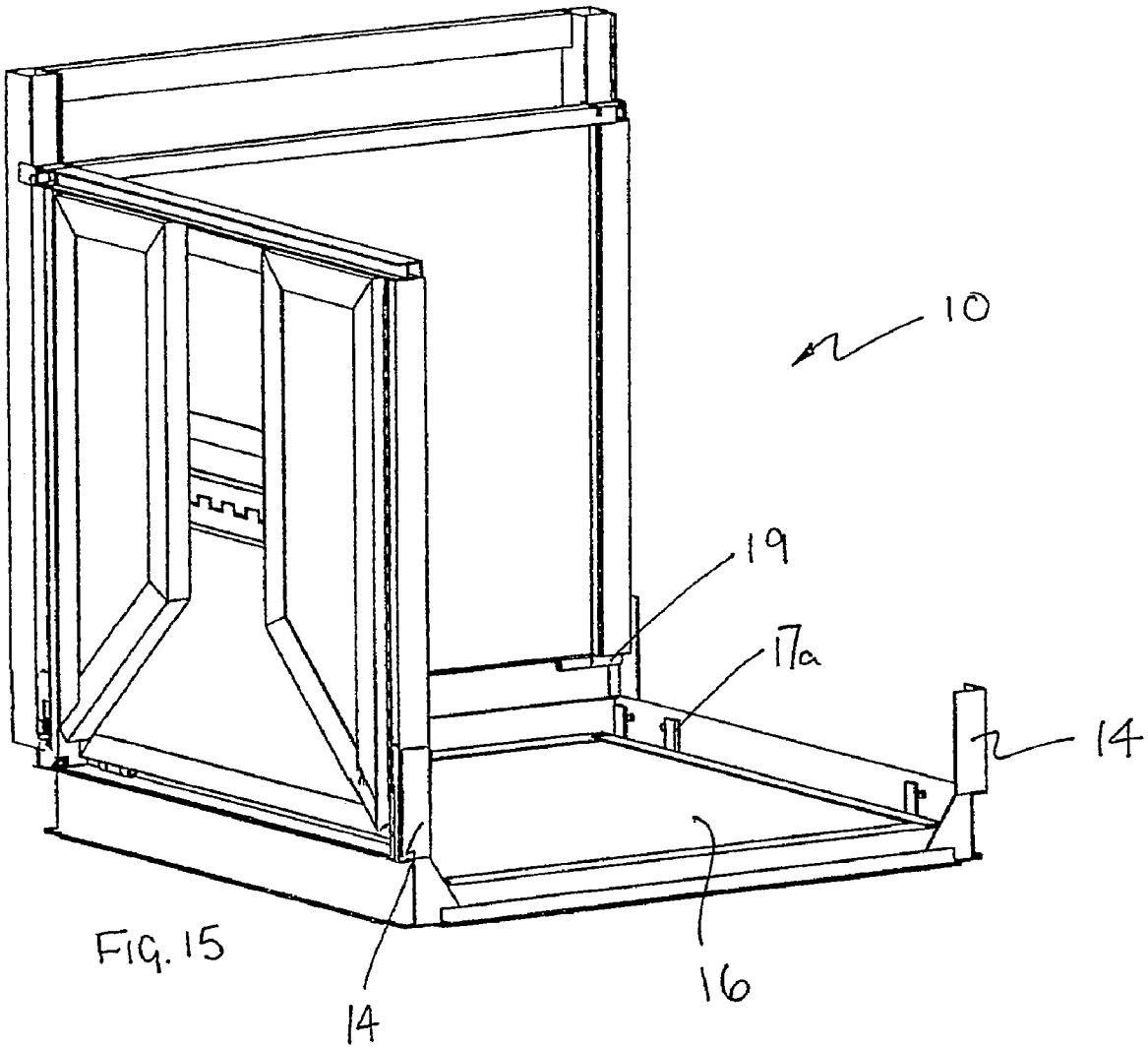
FIG. 15 shows the side wall fully lowered into the base of the container.
Figure 16:
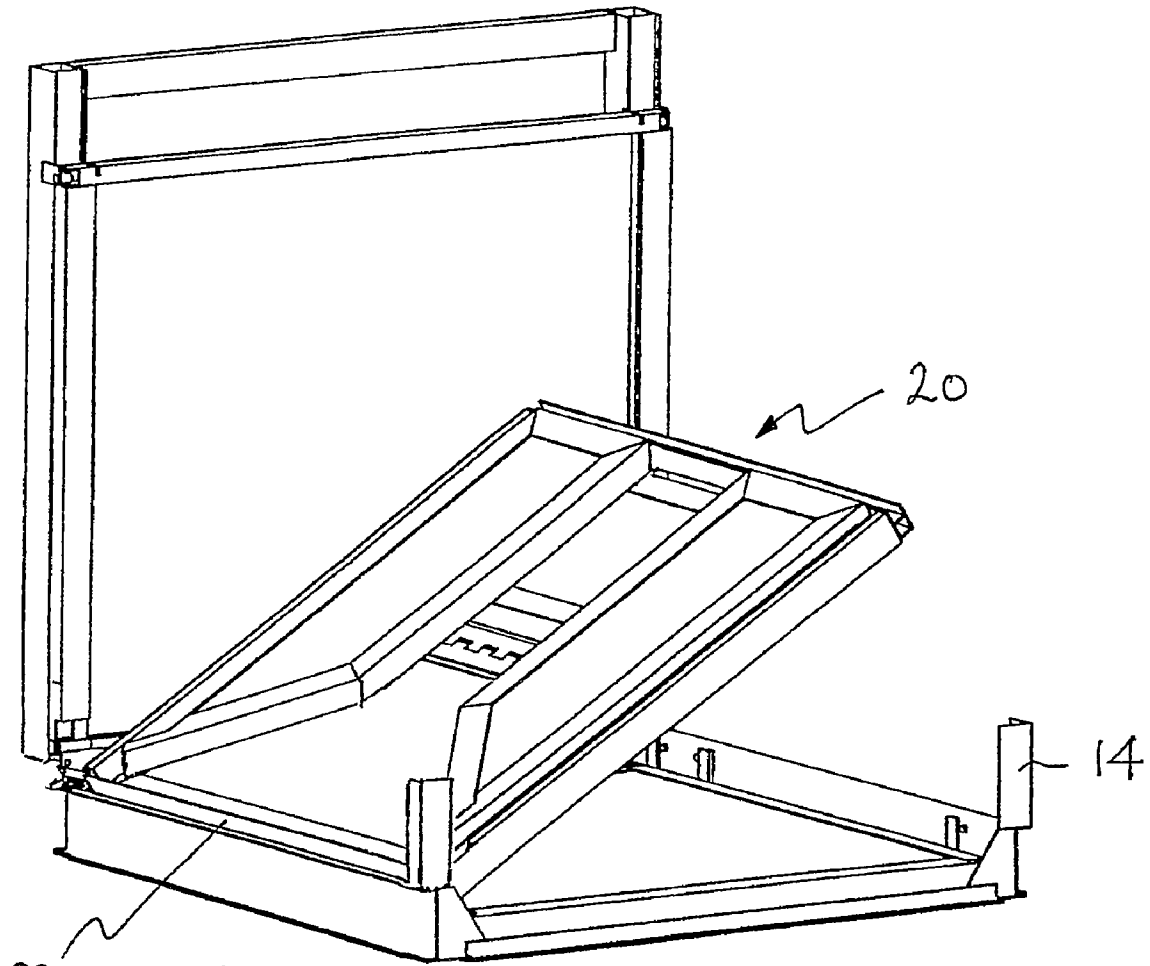
FIG. 16 is an isometric view showing the folded side extension assembly being lowered into the base of the container.

Referring to the drawings, FIGS. 1 to 4 shows an erected air freight container 10. In overall shape, the container comprises a cube with a side extension having a trapezoidal cross section. The container includes a generally square base 12 of a design commonly used on unit load devices. In the embodiment shown in the drawings, four rigid corner posts 14 extend up from each corner of the base 12. However, in other embodiments the corner posts may be omitted. As is best seen in FIGS. 15 and 16, the corner posts 14 have an L-shaped cross-section. A side panel 16 is hinged to the base 12 on slideable hinges 17. As can best be seen in FIGS. 13 and 15, the hinges 17 are mounted between pairs of rails 17*a* so that they can slide vertically up and down the rails between an upper position shown in FIG. 13 and a lower position shown in FIG. 15. A end panel in the form of a back panel 18 is hinged to a short extension panel (not shown) which is in turn connected via hinges 19 (best seen in FIG. 9) to the base 12 and when erected also interlocks with the side panel 16. Adjacent the back panel 18 and opposite the side panel 16, there is a side extension assembly 20 which is generally trapezoidal in cross-section, roughly matching the shape of a typical aircraft's cargo hold wall.

Figure 10:
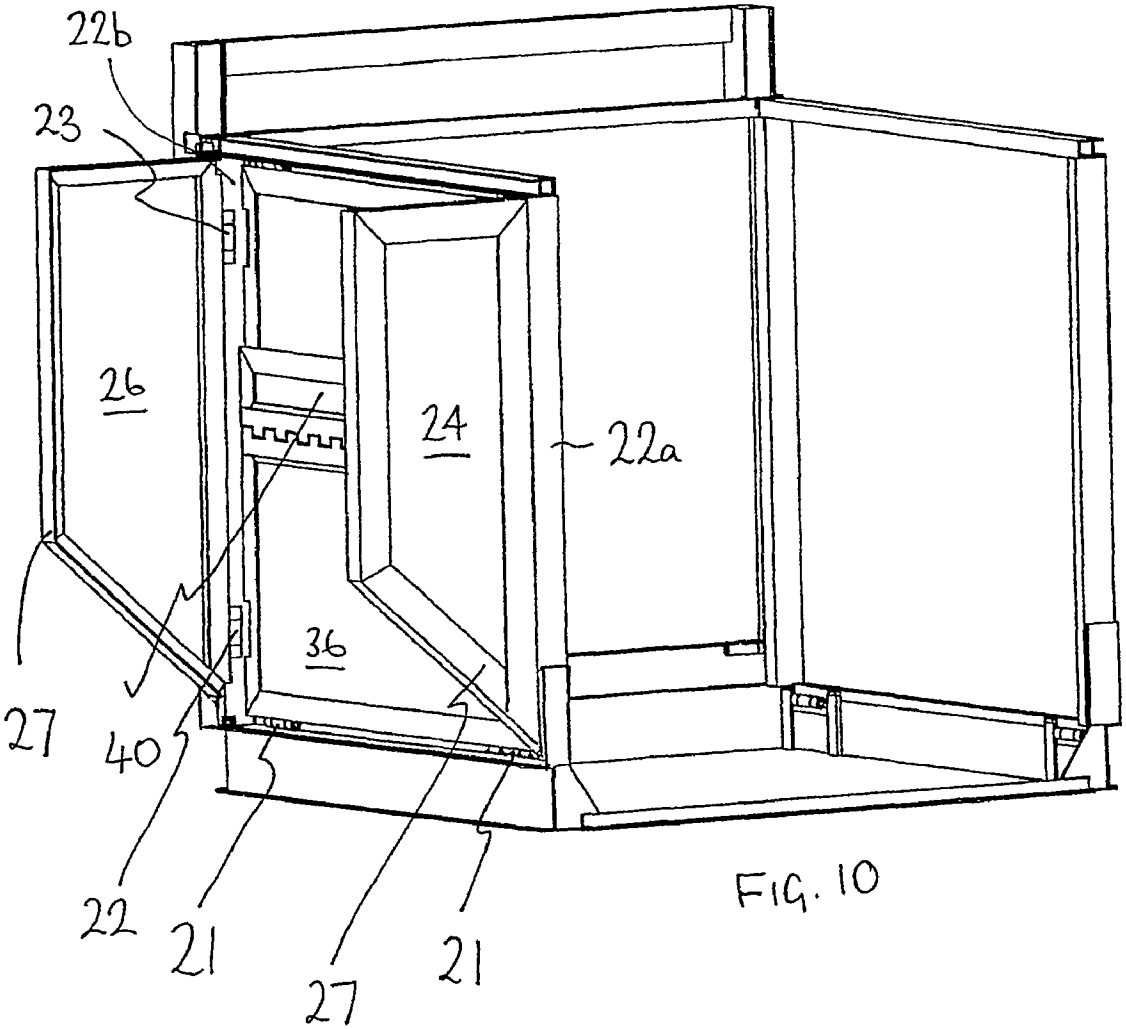
FIG. 10 is a further isometric view illustrating the folding of the side extension.
Figure 12:
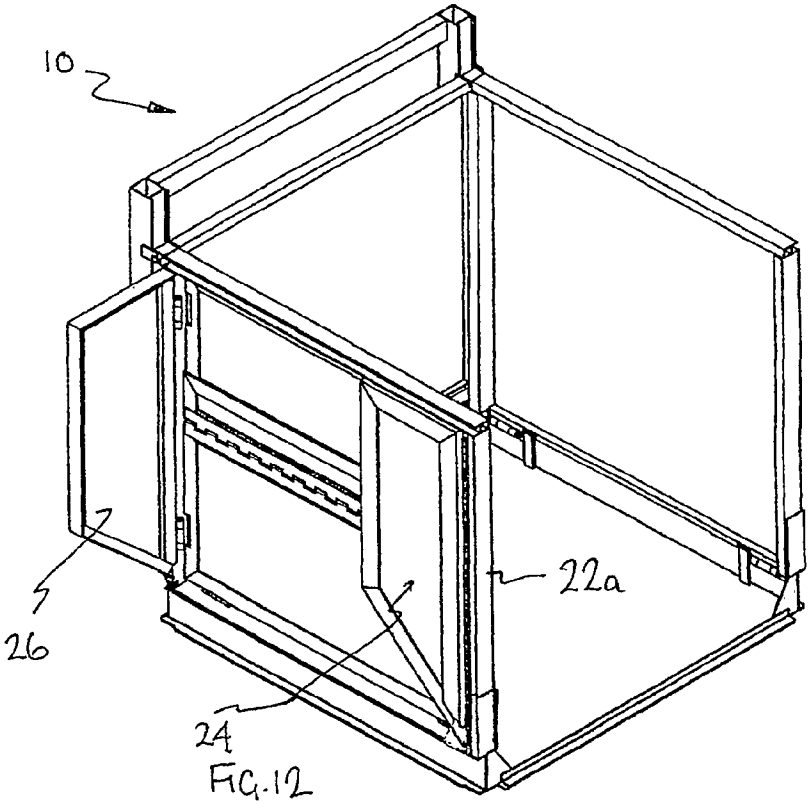
FIG. 12 is an isometric view showing the folding of the front panel extension of the container of FIG. 11.
Figure 11:
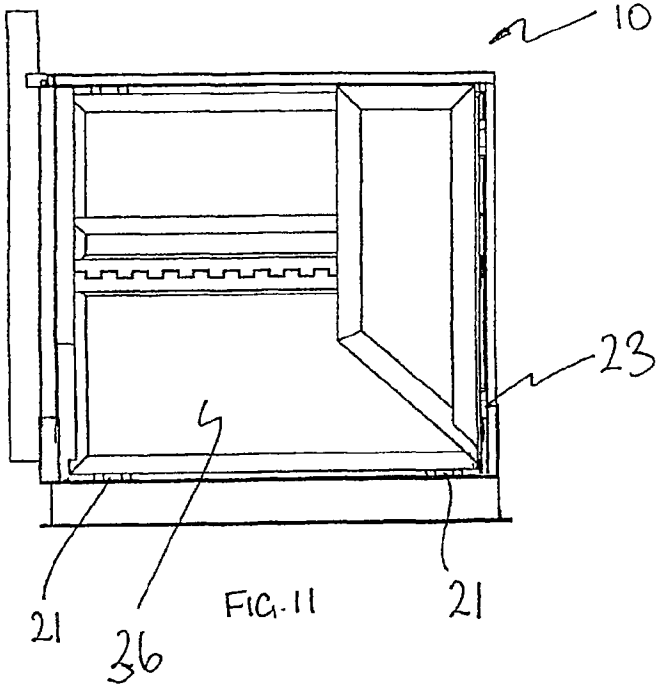
FIG. 11 is a side elevation showing the folding of a front panel extension of the container of FIG. 10.

The side extension assembly 20 comprises a rectangular frame 22 (best seen in FIGS. 4 and 12) and whose external dimensions are the same as the side panel. The frame is generally square and includes four structural edge members each having a square annular cross-section having a thickness approximately the same as the side panel 16 and back panel 18. The structural members define the top, side and bottom edges of the frame 22. The frame 22 is hinged to the base 12 by hinges 21 (best seen in FIG. 10). The frame interlocks with the back panel 18 when the container is in the erected state. Pivotally attached to the front and rear (vertical) edges 22*a*, 22*b* of the frame 22 by hinges 23 (best seen in FIGS. 10 and 11) are front and rear panels, 24 and 26 respectively, referred to hereinafter as front and rear panel extensions. As is best seen in FIG. 11 each panel is trapezoidal and along its top and bottom edges, and along its vertical side edge distal from the frame defines a relatively short angled frame portion 27 extending perpendicular to the plane of the panel and towards the opposite panel.

Figures 1, 2, 3:
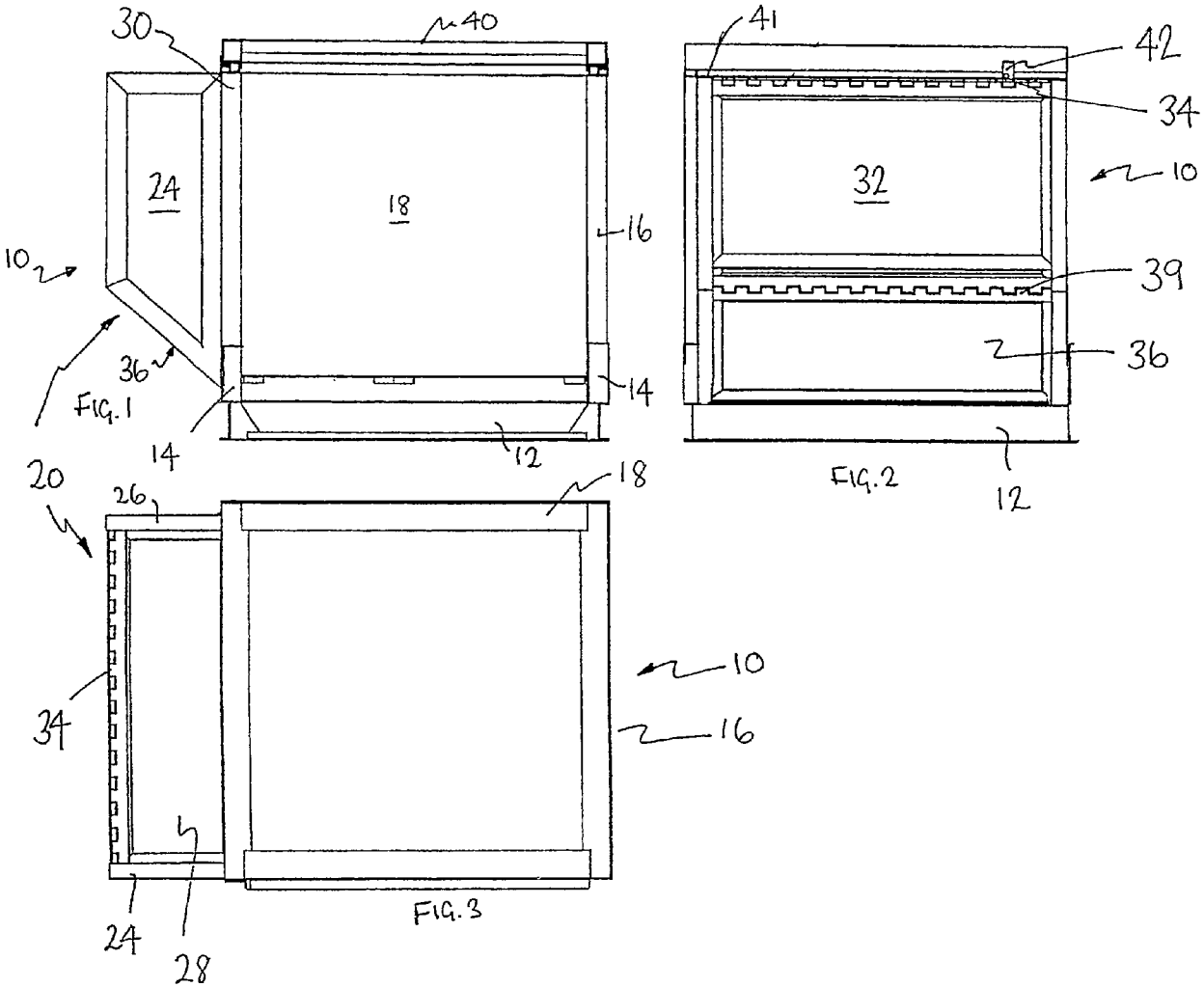
FIG. 1 is a side elevation of a first embodiment of an air freight container embodying the present invention.
FIG. 2 is a front elevation of the air freight container of FIG. 1.
FIG. 3 is a top plan view of the air freight container of FIG. 1.
Figure 4:
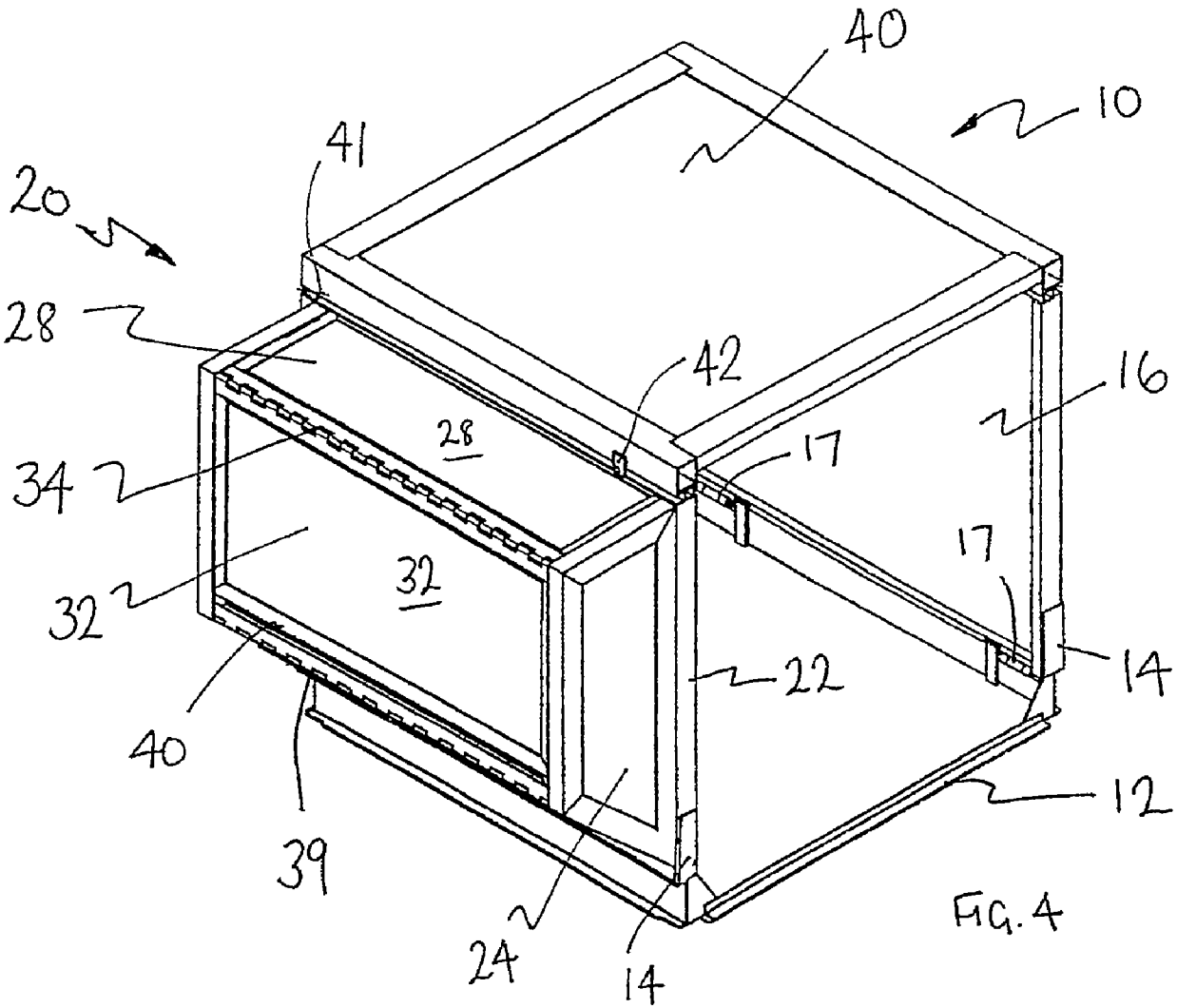
FIG. 4 is an isometric view of the air freight container of FIG. 1.

A side extension lid panel 28 is hinged to the top edge member 30 of the frame. A side wall panel 32 is hinged to, and depends from the lid panel 28 by means of a piano hinge 34. With reference to FIG. 2, a sloping or angled bottom panel 36 is hinged to the bottom edge member 38 of the frame. A relatively short side panel 40 is hinged to the sloping panel 36 via a piano hinge 39 and this forms the lowermost portion of the vertical side wall of the side extension and partly overlaps the lowermost part of the side wall panel 32. The panels are retained in position by latches/clips and are also supported at their edges by the angled frame portions of the front and rear panel extensions.

Figure 6:
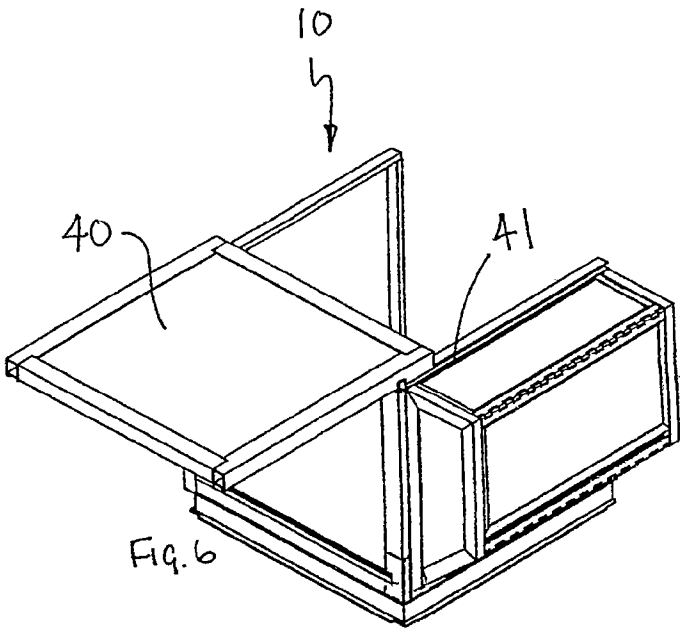
FIG. 6 is an isometric view illustrating the first stage in the folding of the container shown in FIG. 5.
Figure 8:
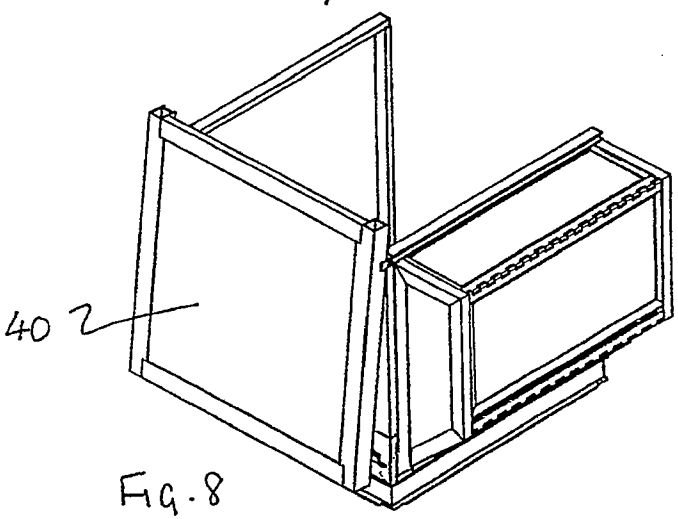
FIG. 8 is an isometric view illustrating the second stage in the folding of the container shown in FIG. 7.
Figure 7:
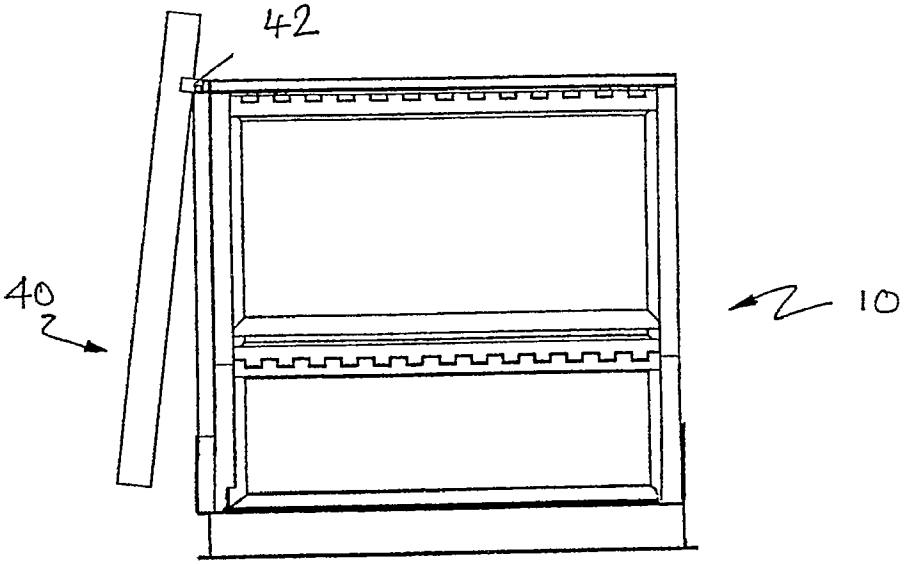
FIG. 7 is a side elevation illustrating a second stage in the folding of the container of FIG. 6.
Figure 18:
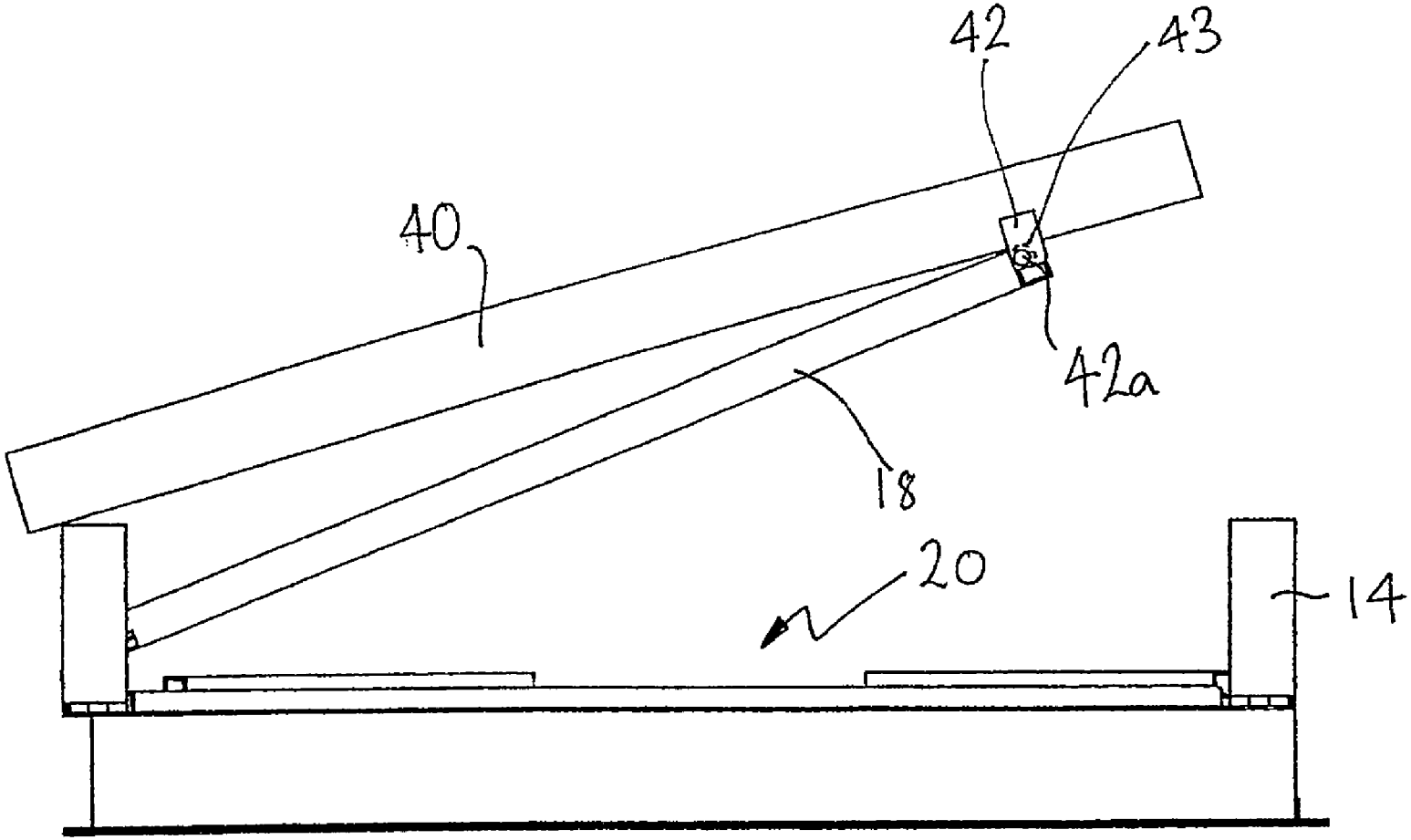
FIG. 18 is a side view showing the lid and rear panel being lowered into the base of the container.
Figure 21:
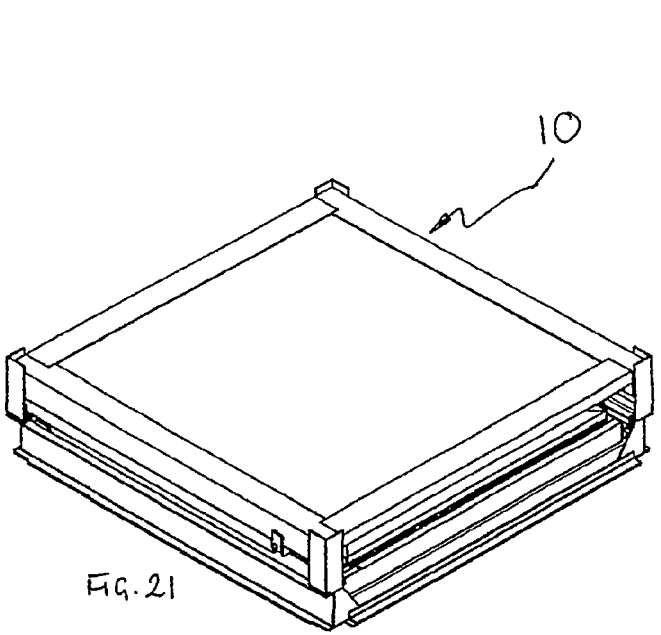
FIG. 21 is an isometric view showing the container in its fully folded state.
Figure 19:
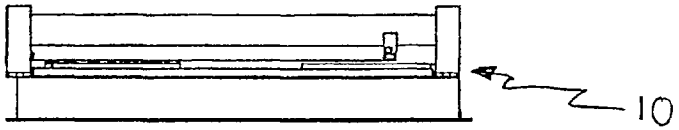
FIG. 19 is a side elevation showing the container in its fully folded state.
Figure 20:
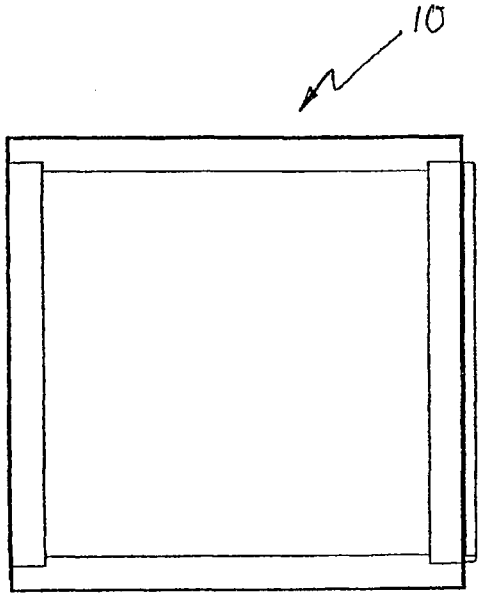
FIG. 20 is a top plan view showing the container in its fully folded state.

A lid 40 is slideably mounted on the top of the container 10. A pair of guide rails in the form of recesses/channels 41 extend along the top of the container and a spigot 42*a* projects from a plate 42 depending from each side of the lid. The spigots are hidden by the respective plates 42 so are not visible in normal use but one is shown at 42*a* in FIG. 18. One spigot 42*a* slidably locates in each channel 41. A further recess 43 (not normally visible but shown in dashed outline in FIG. 18) which aligns with the channel in the erected state is defined in the top of each side edge of the back panel 18. When slid back to the position shown in FIGS. 5 and 6, the spigots slide along the channels 41 and then into the further recesses 43 in the top of the back panel. The lid can then pivot about the spigots and overly the back panel 18, as shown in FIGS. 7 and 8. The open front of the container may be covered by a flexible curtain (not shown) to protect the contents of the container from adverse weather during the loading process.

Figure 5:
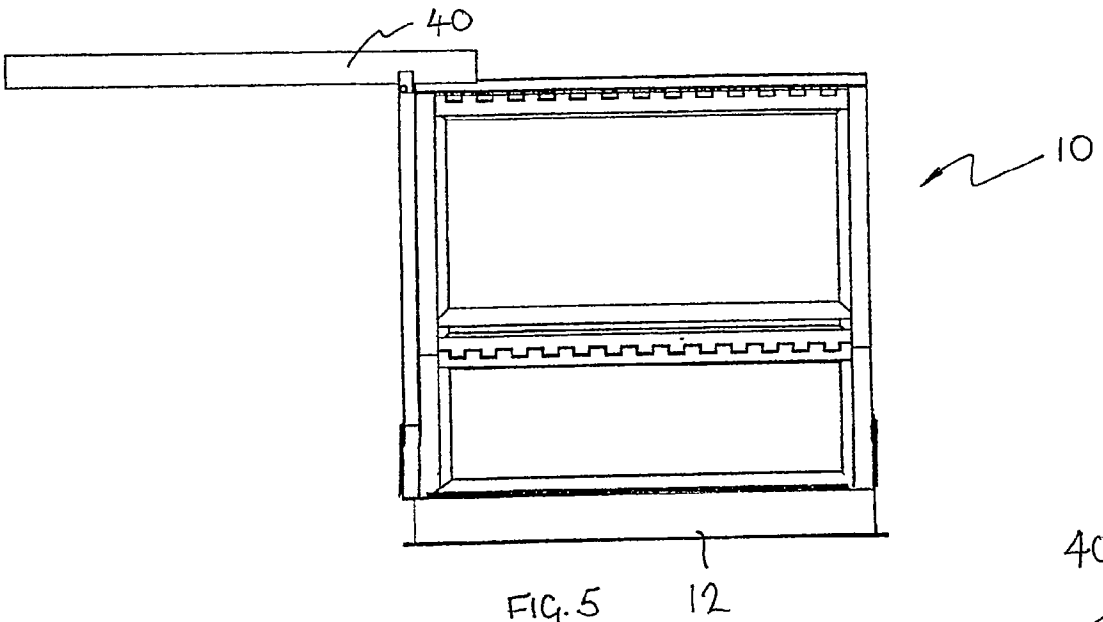
FIG. 5 is a side elevation illustrating a first stage in the folding of the container of FIG. 1.

FIGS. 5 onwards illustrate the procedure for collapsing/folding the container 10 from the erected/operational position shown in FIGS. 1 to 4. First, the flexible curtain, if present, is lifted and placed on top of the lid. Next, with reference to FIGS. 5 and 6, the lid 40 is slid towards the rear of container. As shown in FIGS. 7 and 8, the lid is then pivoted so that hangs generally parallel to the back panel 18.

Next the side wall panel 32 is unlatched and the side panel 32 and lid panel 28 are unlatched and allowed to hang in a vertical orientation.

The sloping bottom panel 36 and short side wall panel portion 40 are then lifted into a vertical position adjacent the side wall panel 32 and lid panel 28.

Next the front and rear panel extensions 24 and 26 are swung about a vertical axis towards each other to rest against the panels 28, 32 and 36, as shown in FIGS. 10 to 13. As can be seen, the panels of the side extension when collapsed fit within the thickness of the frame 22. This assists in making the container particularly compact when collapsed.

Figure 13:
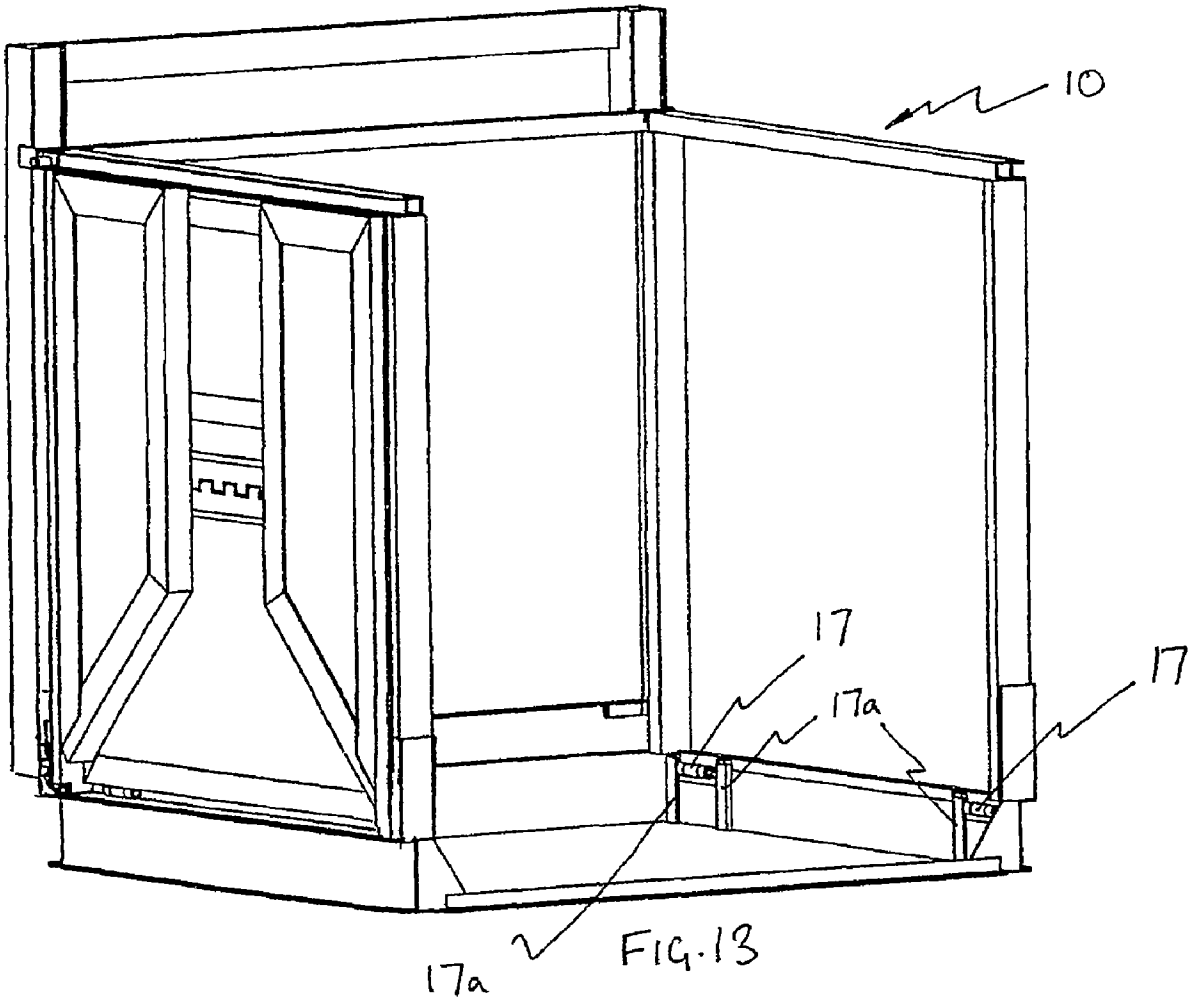
FIG. 13 is an isometric view showing the side extension fully collapsed prior to folding the side extension into the base of the container.
Figure 14:
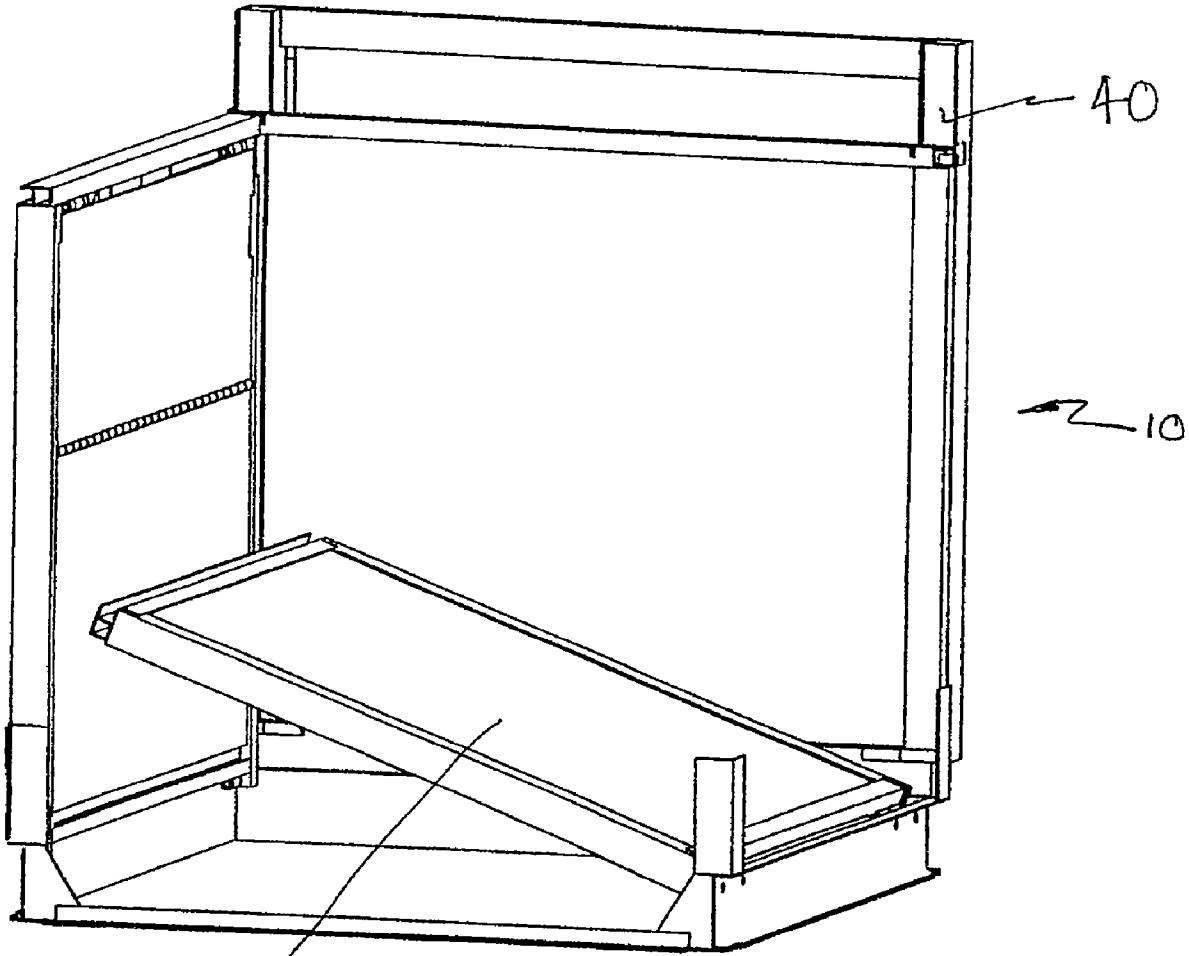
FIG. 14 is an isometric view showing a side wall being lowered into the base of the container of FIG. 13.

The side panel 16 is then unlatched from the back panel 18 and is folded into the base and slid down on the slideable hinges 17 (best seen in FIGS. 13 to 15).

Figure 17:
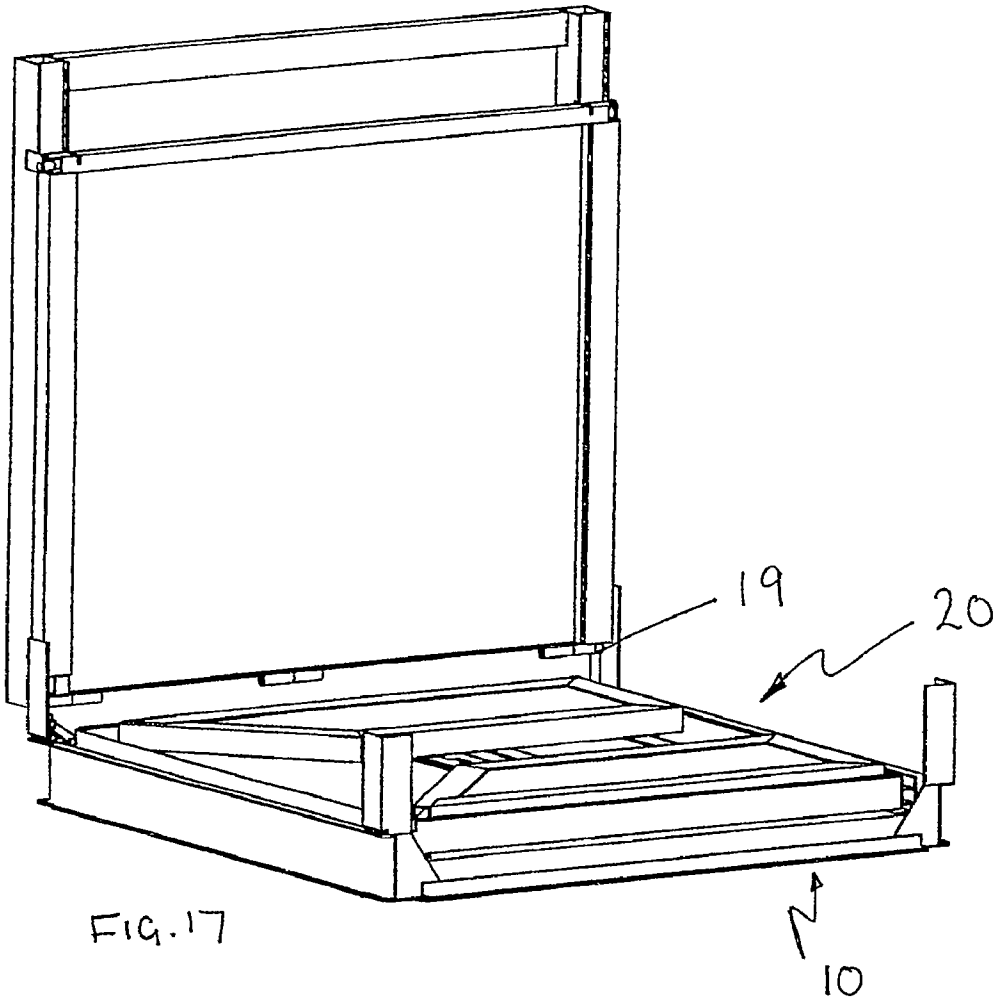
FIG. 17 shows the side extension fully lowered into the base of the container.

Next the folded side extension 20 and frame 22 are pivoted towards the base and onto the side panel 16 as is best seen in FIGS. 16 and 17.

Finally the back panel 18 and lid 40 are folded down to rest on the base as shown in FIGS. 18 to 21.

Figure 23:
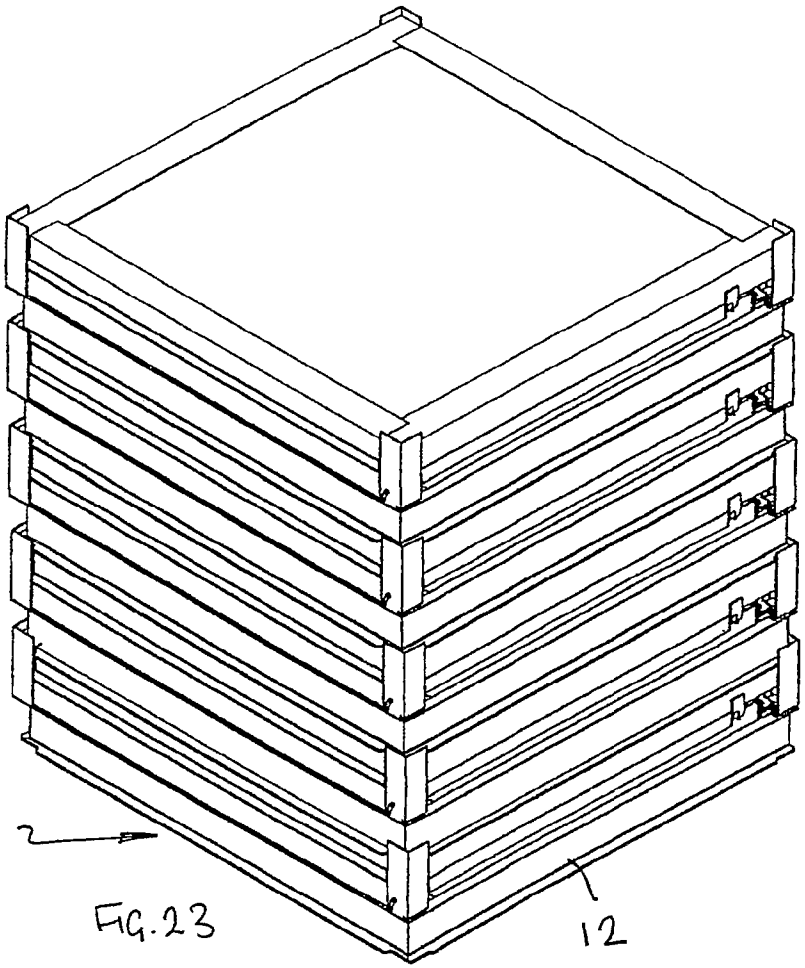
FIG. 23 is an isometric view of the stack of folded containers of FIG. 22.
Figure 22:
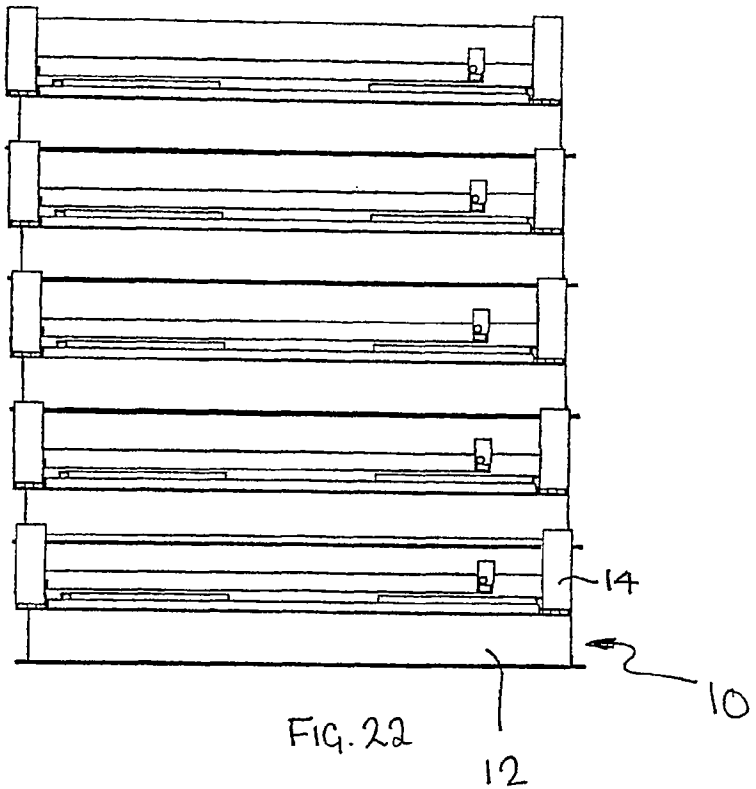
FIG. 22 is a side elevation showing a stack of folded containers.

The upper surface of the lid 40 is below the tops of the corner posts so that the folded containers can be stacked as shown in FIGS. 22 and 23 with the corners posts preventing the folded containers from sliding relative to one another. However, as discussed above, the corner posts are inessential and may be omitted. Five or six folded containers will fit in the volume occupied by a typical standard unit load device.

Erection of the container is the reverse of the folding procedure described above.

The panels may be made of any suitable material including, but not limited to aluminium, Perspex or lightweight strong composite materials. Containers may be made with opaque or transparent panels as desired by the operator. The corner posts 14, if present and the major structural/load bearing components will typically be made from an extruded aluminium alloy, for lightness and strength although other suitable materials could be used. Typically the container will weigh of the order of 80 Kg which is comparable with existing non-collapsible containers/unit load devices.

Various clips and latches are provide for preventing unintentional collapse of the container. It will be appreciated by the skilled person that the particular structure or form of those clips/latches is not critical.

FIGS. 24 to 42 illustrate a second embodiment 100 of a collapsible container and the folding of that variant. The second embodiment 100 is very similar to the first embodiment and shares many features in common and those features common to both embodiments carry the same reference numerals as in FIGS. 1 to 23 and those features are as described above. The major differences are in the lid of the side extension 24 which in the embodiment 100 slides into the main lid 40 and in the frame 122 of the side extension.

FIGS. 24 to 27 show an erected air freight container 100 which again in overall shape comprises a cube with a side extension having a trapezoidal cross section. The container includes a generally square base 12 of a design commonly used on unit load devices. In the embodiment shown in the drawings, four rigid corner posts 14 extend up from each corner of the base 12. A side panel 16 is hinged to the base 12 on slideable hinges 17. As is the first embodiment, the hinges 17 are mounted between pairs of rails 17*a* so that they can slide vertically up and down. An end panel in the form of a back panel 18 is hinged to a short extension panel (not shown) which is in turn connected via hinges 19 (best seen in FIG. 36) to the base 12 and when erected also interlocks with the side panel 16. Adjacent the back panel 18 and opposite the side panel 16, there is a side extension assembly 120 which is generally trapezoidal in cross-section, roughly matching the shape of a typical aircraft's cargo hold wall. A lid 40 is slideably mounted on the top of the side and back panels.

Figure 31:
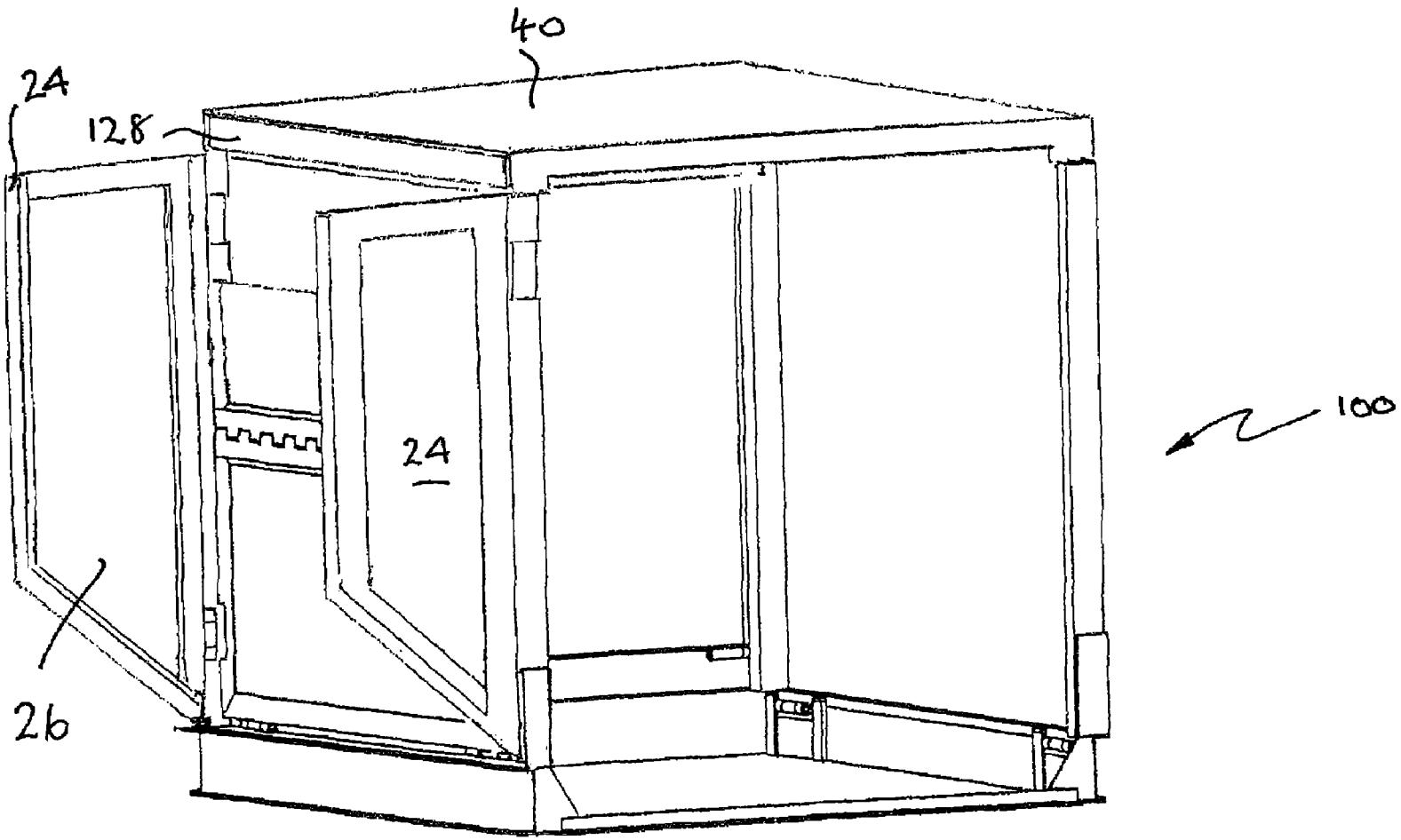
FIG. 31 is an isometric view illustrating a fourth stage in the folding of the side extension shown in FIG. 30.

The side extension assembly 120 comprises a rectangular frame 122 (best seen in FIGS. 27 and 35) and whose external dimensions are the same as the side panel. The frame 122 is generally square and includes four structural edge members each having a square annular cross-section having a thickness approximately the same as the side panel 16 and back panel 18. The structural members define the top, sides 123 and bottom edges of the frame 122. The frame 122 is hinged to the base 12 by hinges 21 (best seen in FIG. 28). The frame interlocks with the back panel 18 when the container is in the erected state. Pivotally attached to the front and rear (vertical) edges 123 of the frame 122 by hinges 23 (best seen in FIG. 28) are front and rear panels, 24 and 26 respectively, referred to hereinafter as front and rear panel extensions. As is best seen in FIG. 31 each panel is trapezoidal and along its bottom edge, and along its vertical side edge distal from the frame defines a relatively short angled frame portion 27 extending perpendicular to the plane of the panel and towards the opposite panel.

Figure 28:
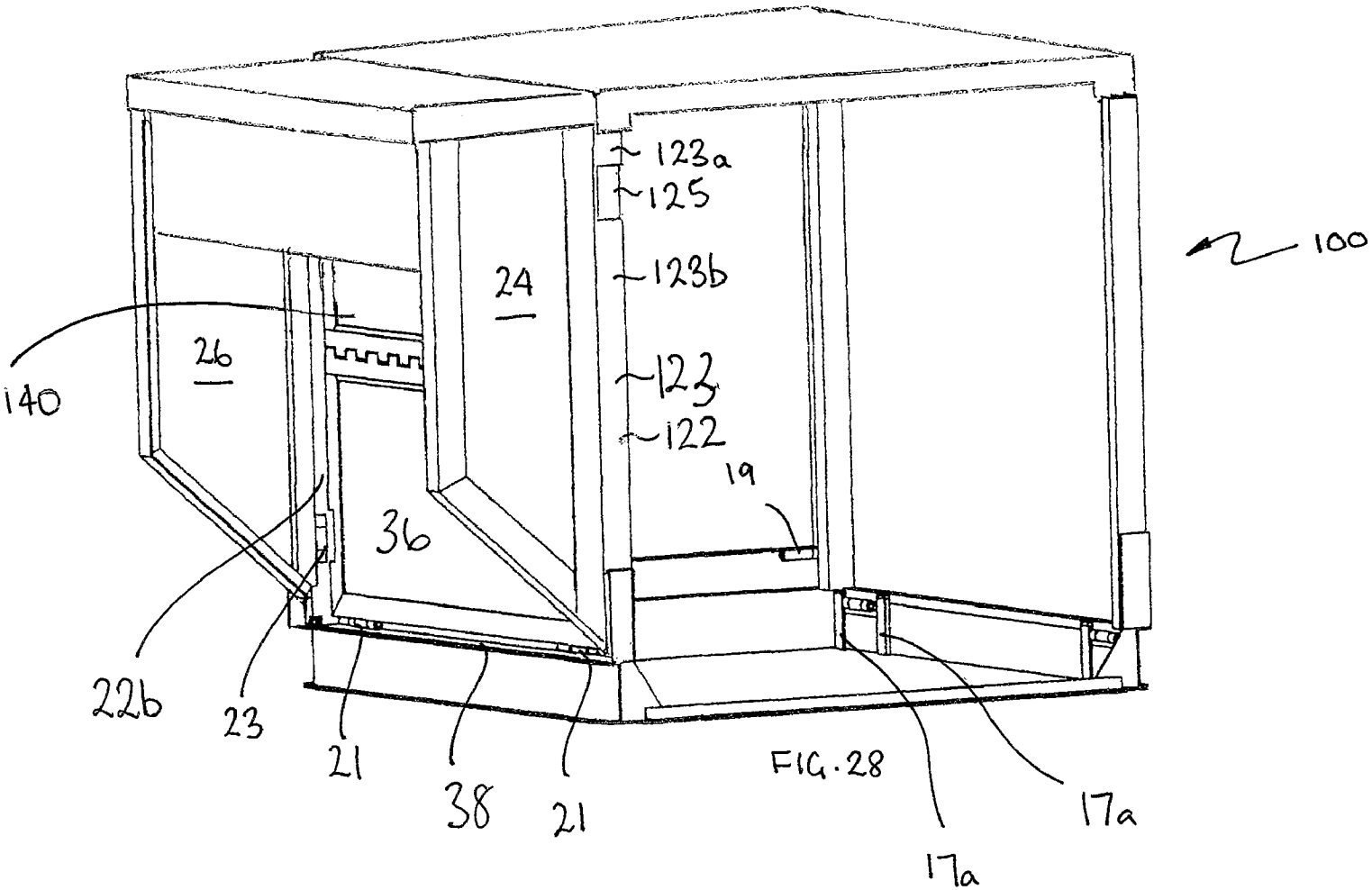
FIG. 28 is an isometric view illustrating a first stage in the folding of the container of FIG. 24, being the folding of a side extension.
Figure 30:
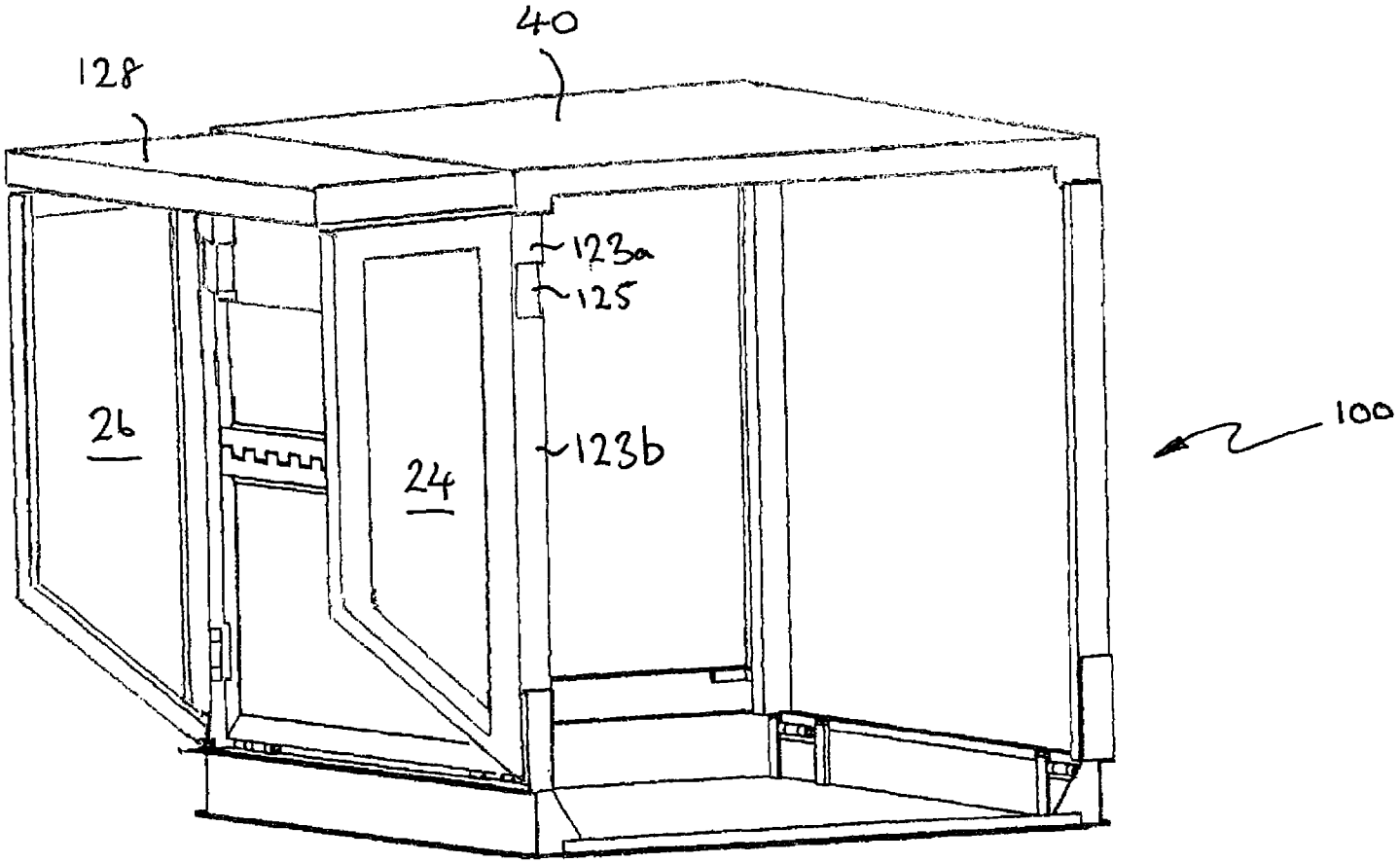
FIG. 30 is a side elevation illustrating a third stage in the folding of the side extension of FIG. 29.

The length of the front and rear vertical sides of the frame 123 is adjustable and the sides comprise a first top portion 123*a* adjustably linked to a second lower portion 123*b* by a connecting portion 125. FIG. 28 shows the length of the sides 123 in the assembled configuration of the container 100. With reference to FIG. 30, the top portion 123*a* of each side of the frame 122, may be slid on the connecting portion 125 and lowered towards the lower portion 123*b*, reducing the height of the frame and lowering the top of the frame relative to the lid 128. Note that the front and rear panels are hinged to the lower portions 123*b* of the frame.

Figures 24, 25, 26:
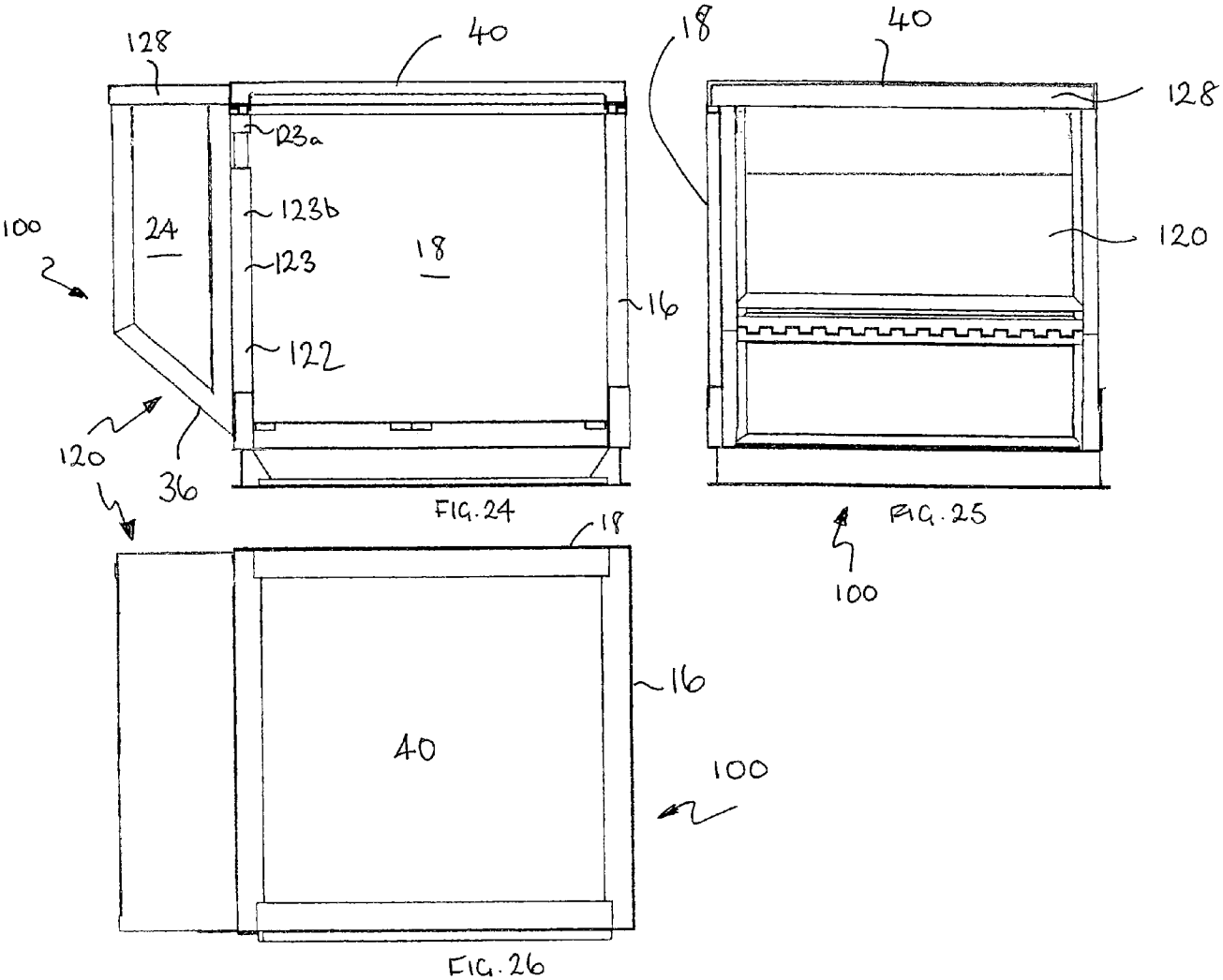
FIG. 24 is a side elevation of a second embodiment of an air freight container embodying the present invention.
FIG. 25 is a front elevation of the air freight container of FIG. 24.
FIG. 26 is a top plan view of the air freight container of FIG. 24.
Figure 27:
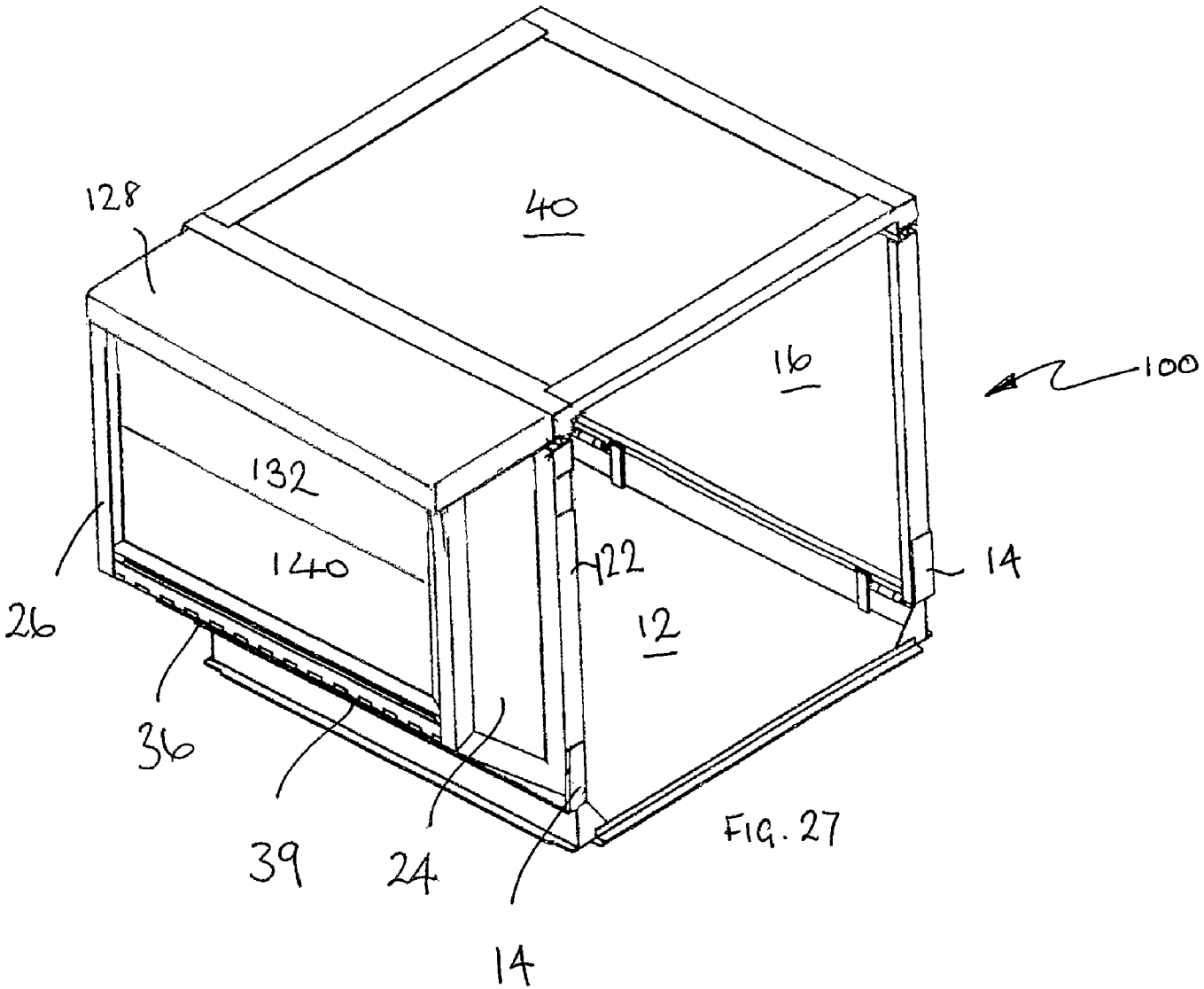
FIG. 27 is an isometric view of the air freight container of FIG. 24.

A side extension lid panel 128 is slideably mounted to the lid 40. With reference to FIGS. 30 and 31 in particular the side extension lid 128 can telescopically slide underneath the lid 40. A part side wall panel 132 is hinged to, and depends from the lid panel 128 by means of hinge, not shown. With reference to FIGS. 24, 27 and 28, a sloping or angled bottom panel 36 is hinged to the bottom edge member 38 of the frame. A part side panel 140 is hinged to the sloping panel 36 via a piano hinge 39 and this forms the lowermost portion of the vertical side wall of the side extension and partly overlaps the lowermost part of the side wall panel 132. The panels are retained in position by latches/clips and are also supported at their edges by the angled frame portions of the front and rear panel extensions.

The main lid 40 is mounted to the container in the same manner as in the first embodiment.

FIG. 28 onwards illustrate the procedure for collapsing/folding the container 10 from the erected/operational position shown in FIGS. 24 to 27. First, the flexible curtain, if present, is lifted and placed on top of the lid.

Figure 29:
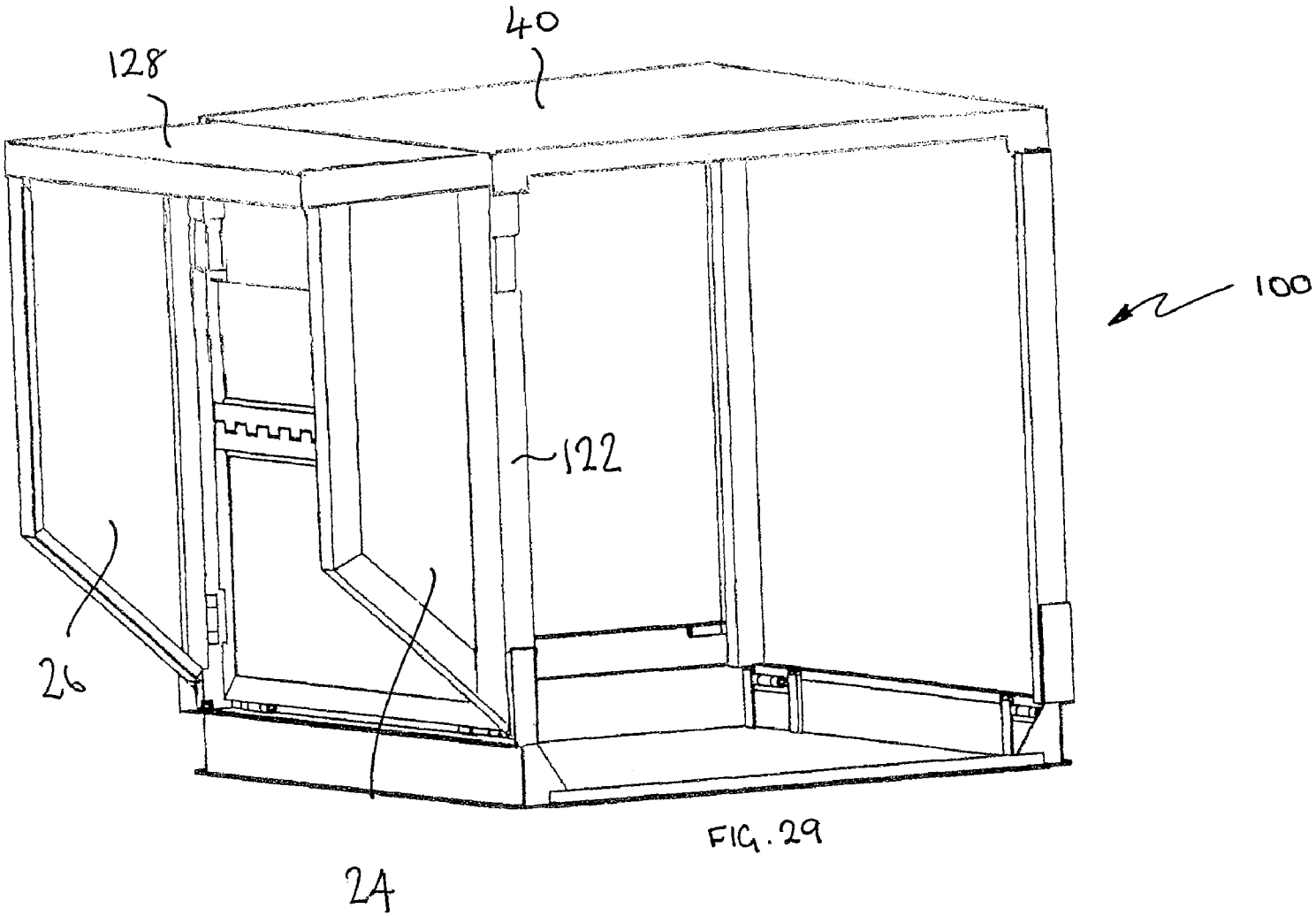
FIG. 29 is an isometric view illustrating a second stage in the folding of the side extension of the container shown in FIG. 28.

Next, as shown in FIG. 28 the lowermost part of the side wall panel 140 and bottom panel 36 is lifted and secured to the frame 22. The top side wall panel 132 is folded up into the lid 128 and secured to the same as shown in FIG. 29.

The front and rear side panels are then lowered relative to the lid 128 as shown in FIG. 30, by adjusting the of the frame 22.

Figure 32:
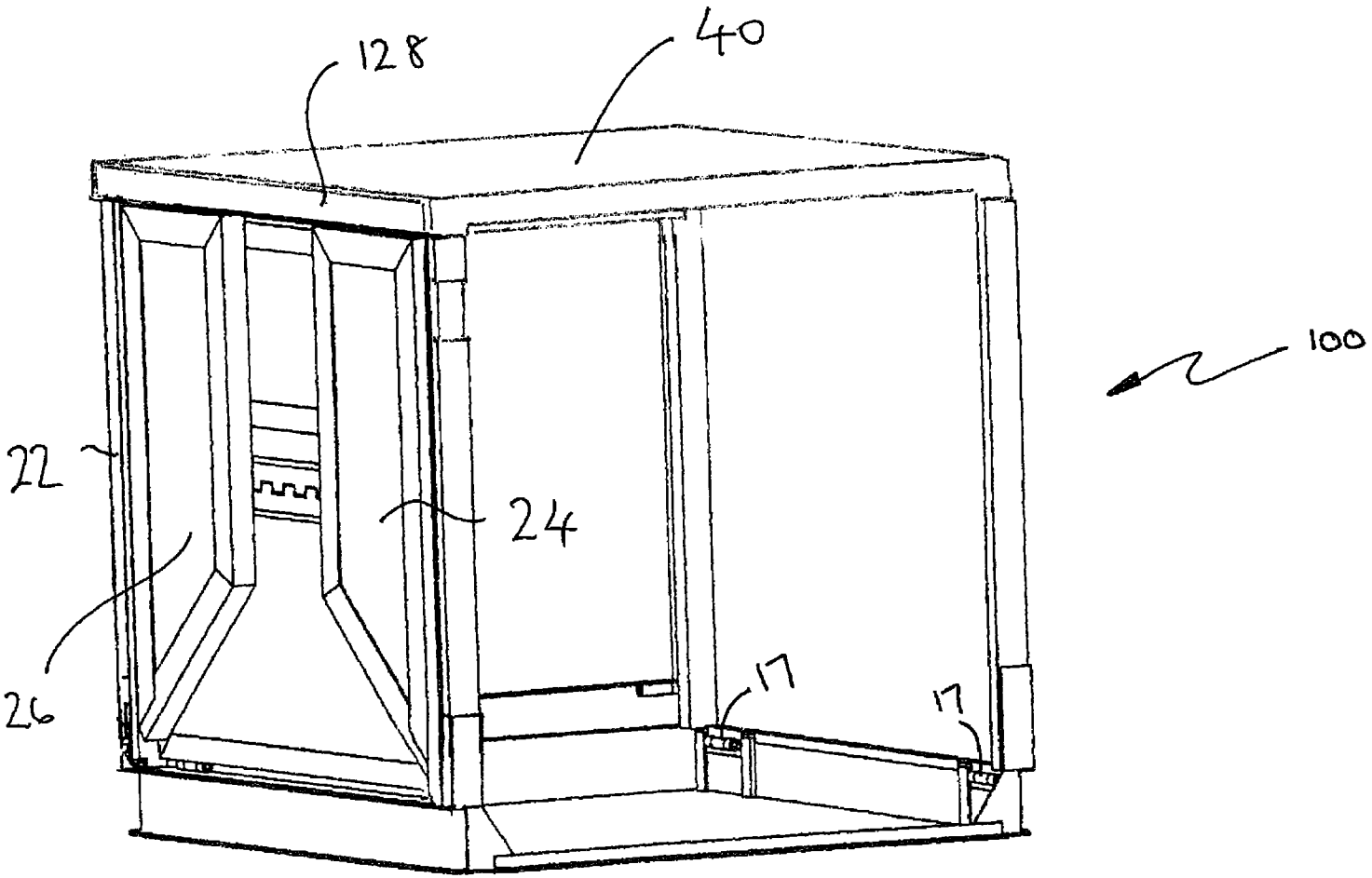
FIG. 32 is an isometric view illustrating a further stage in the folding of the side extension shown in FIG. 31.

With reference to FIGS. 31 and 32, the side extension lid 128 is slid into the main lid 40, and the front 24 and rear 26 panels folded into the frame 22. As can be seen the extension lid fits within the main lid 40, and the front and rear panels 24, 26 fit within the frame 22.

Figure 33:
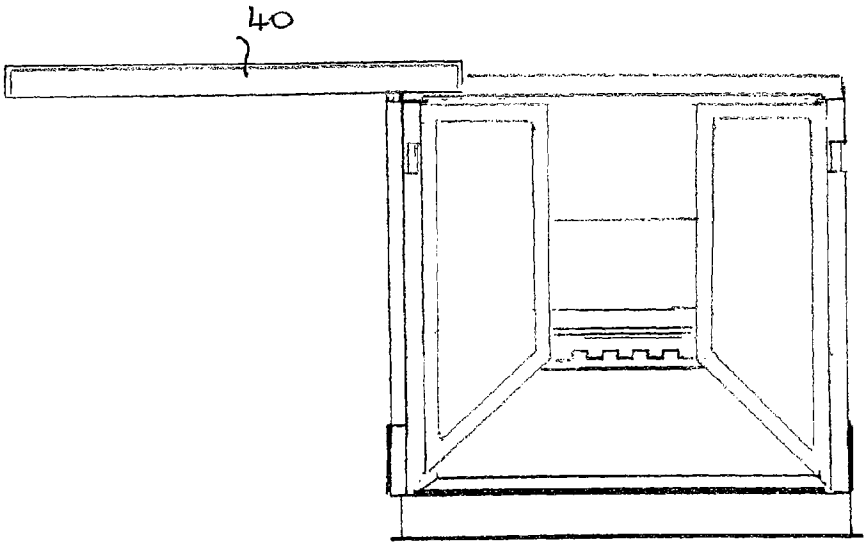
FIG. 33 is a side view illustrating a further stage in the folding of the container being the sliding of the lid.
Figure 34:
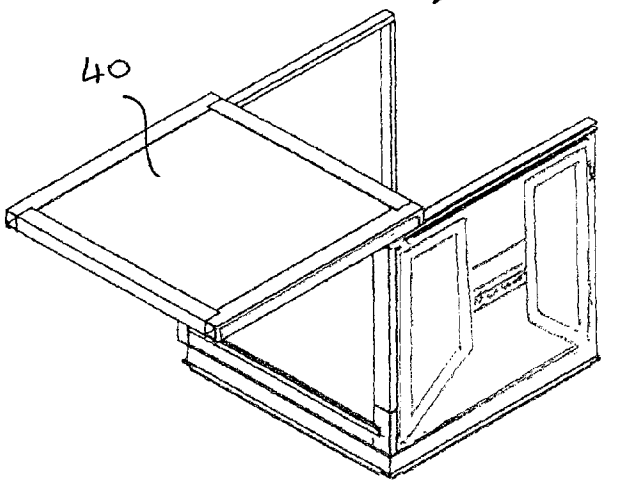
FIG. 34 is an isometric view showing the further stage illustrated in FIG. 34.
Figure 35:
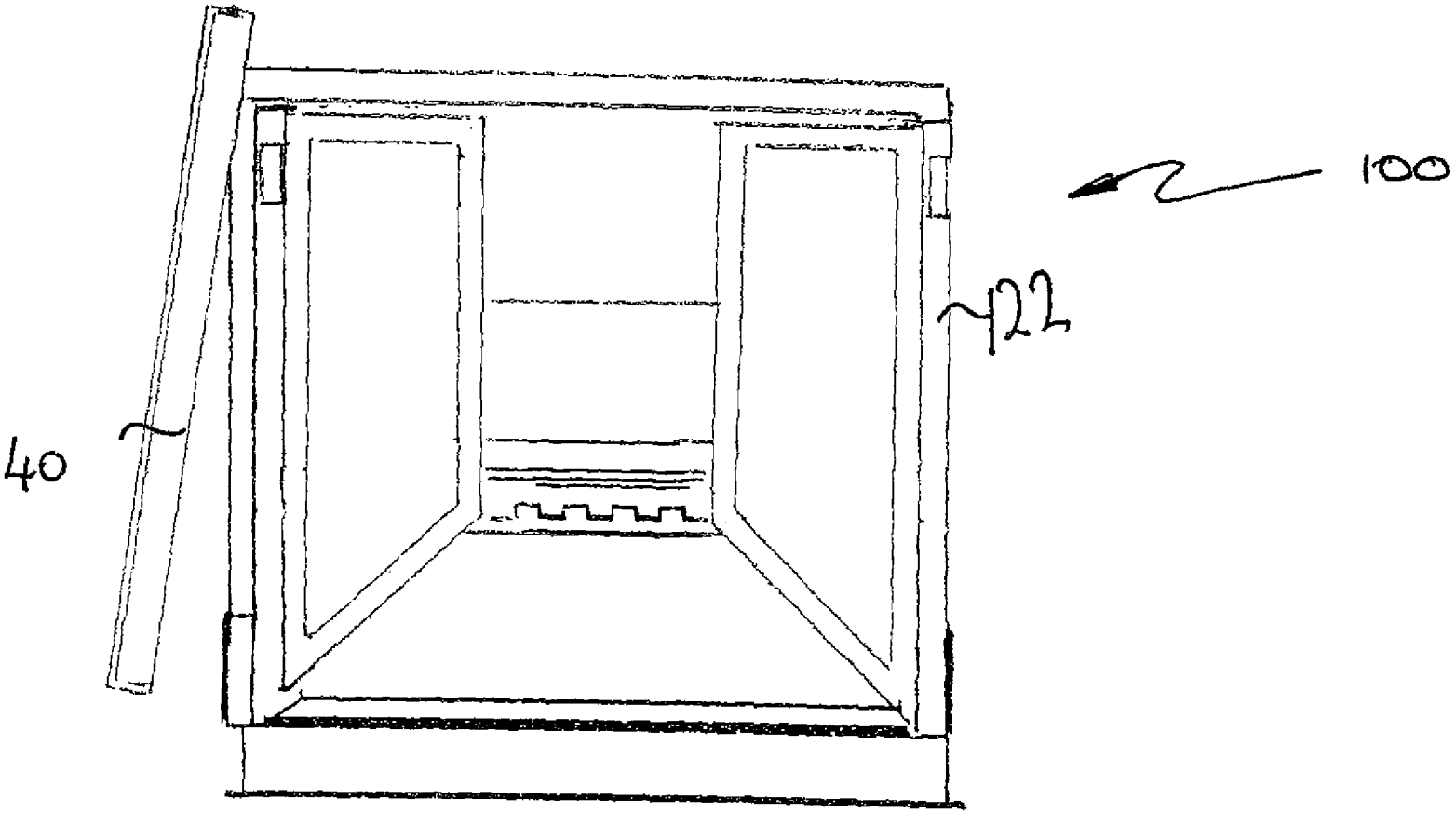
FIG. 35 is a side view showing the folding of the lid of the container of FIG. 34.
Figure 36:
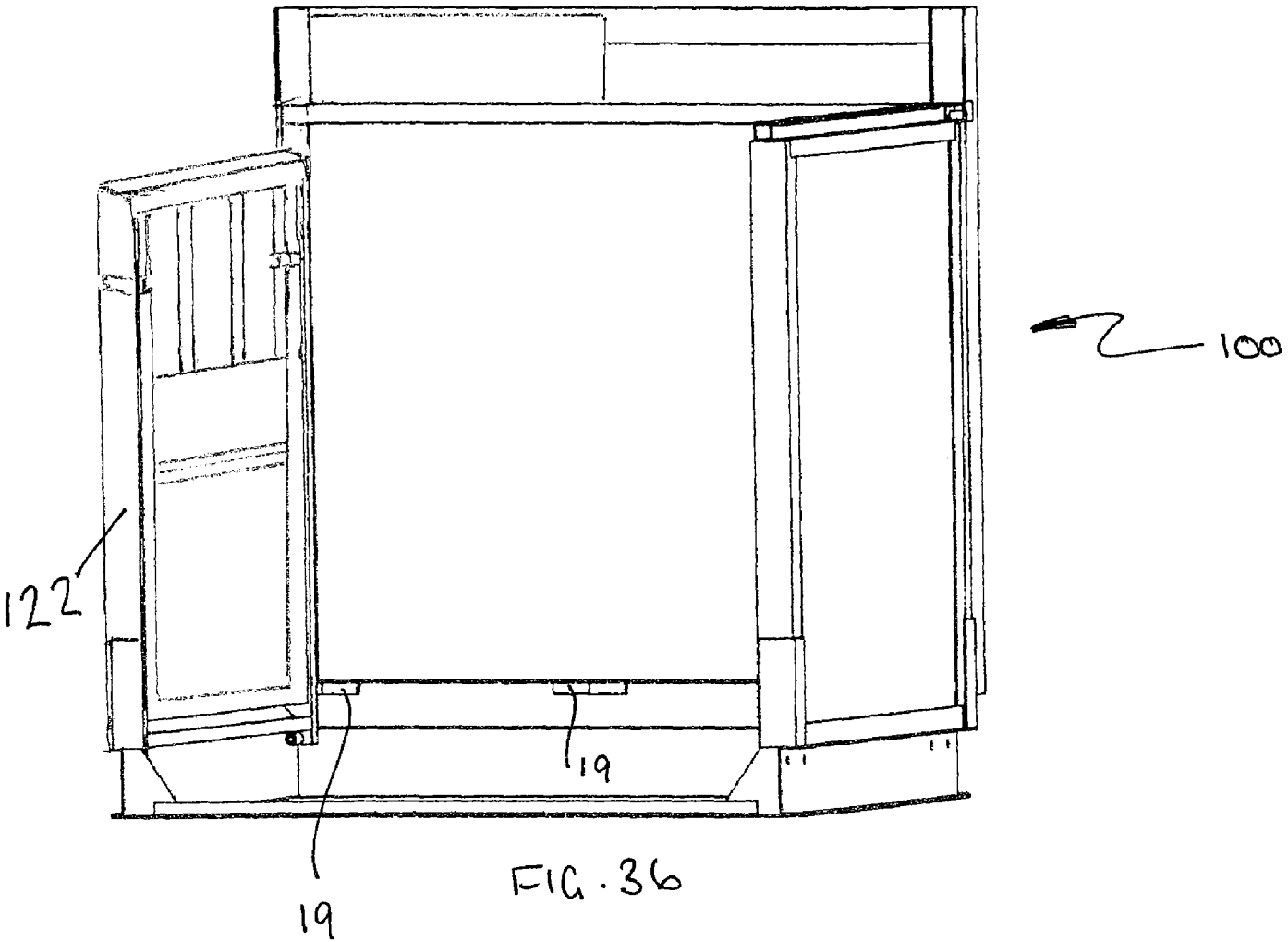
FIG. 36 is an isometric view showing the container prior to folding the side walls into the base of the container.

With reference to FIGS. 33 to 35, the lid 40 is slid towards the rear of container. As shown in FIGS. 35 and 36, the lid is then pivoted through 90° so that hangs generally parallel to the back panel 18.

Figure 37:
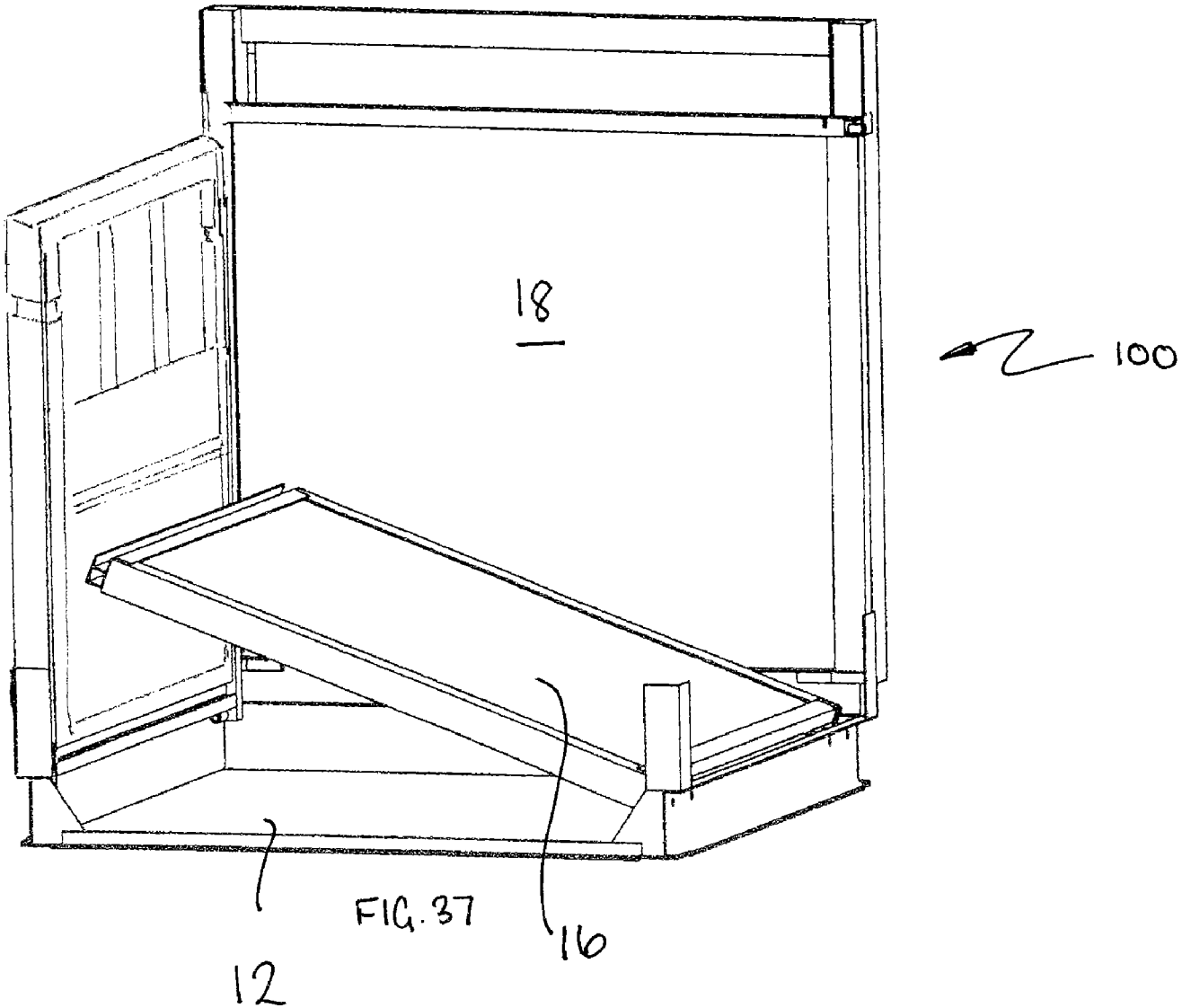
FIG. 37 is an isometric view showing a side wall being lowered into the base of the container of FIG. 36.
Figure 38:
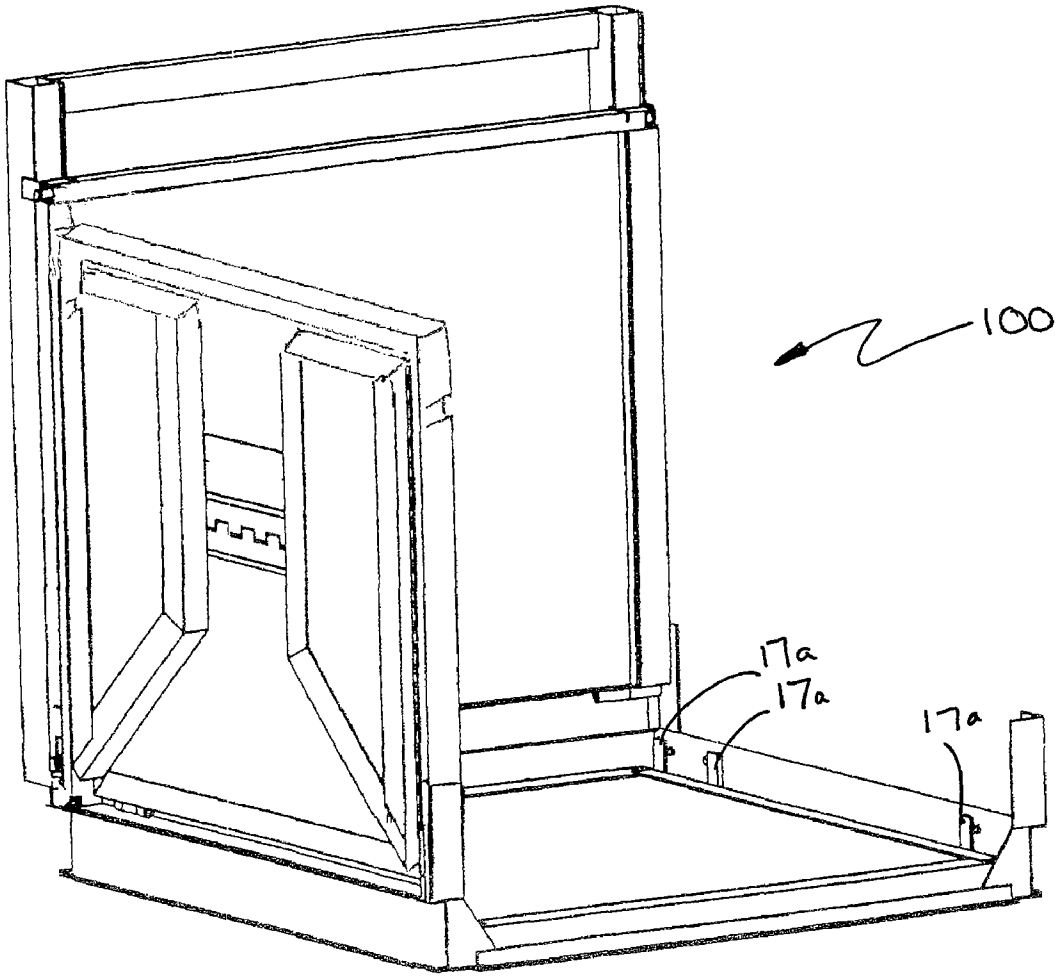
FIG. 38 shows the side wall fully lowered into the base of the container.

Next with reference to FIG. 37, the side panel 16 is unlatched from the back panel 18 and slid down on the slideable hinges 17, 17*a* and folded into the base 12.

Figure 39:
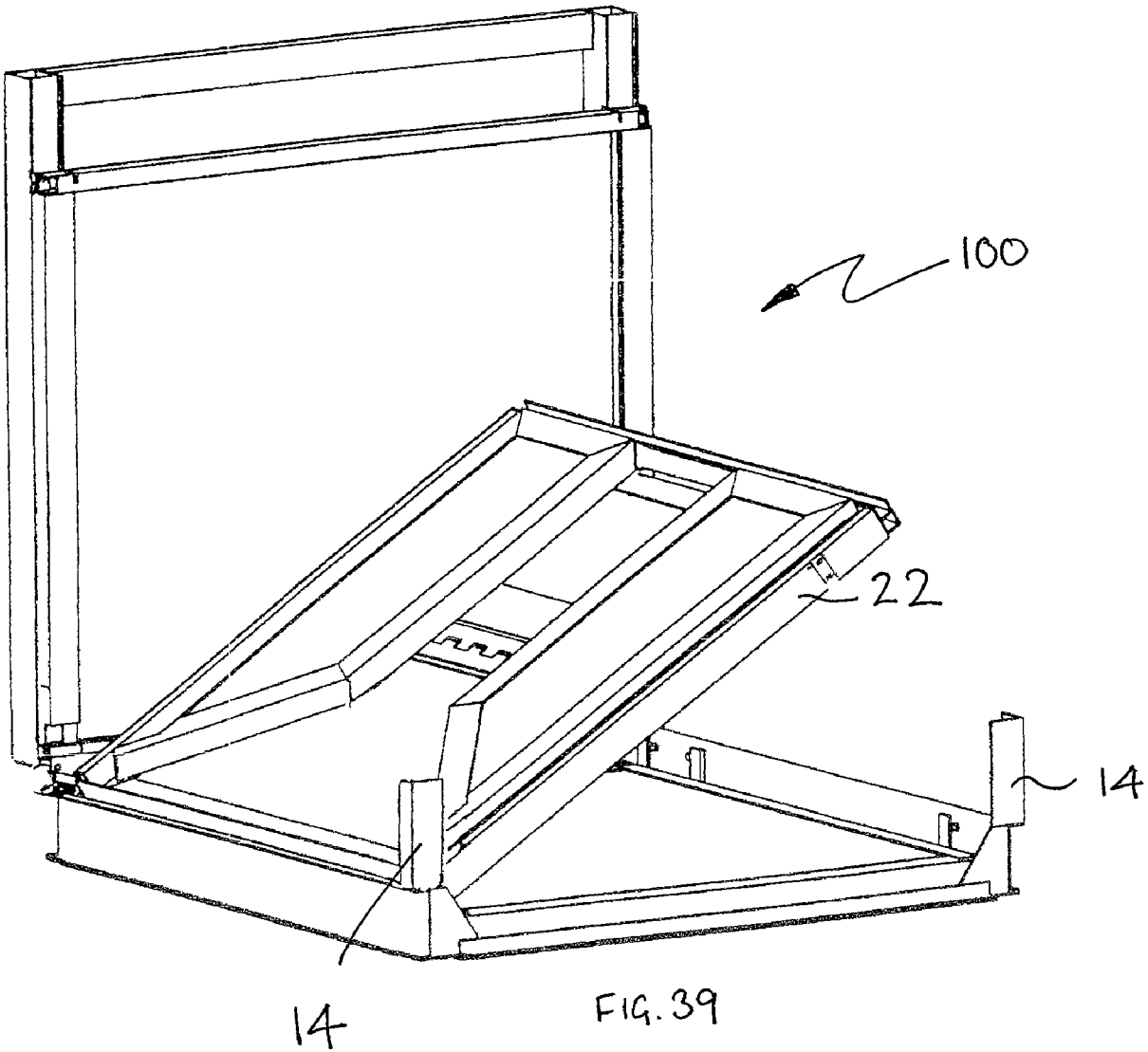
FIG. 39 is an isometric view showing the folded side extension assembly being lowered into the base of the container.
Figure 40:
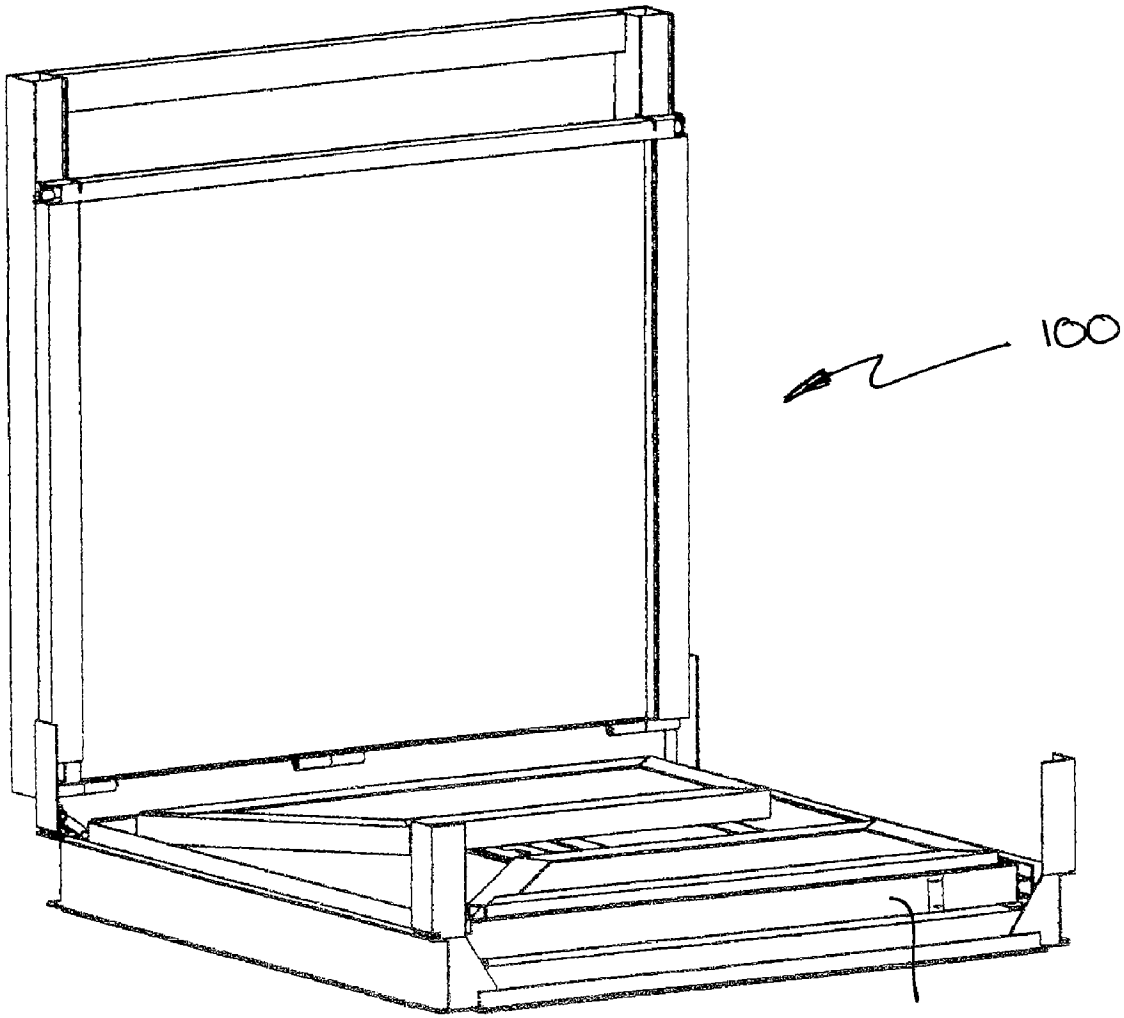
FIG. 40 shows the side extension fully lowered into the base of the container.

The folded side extension is then lowered into the base as shown in FIGS. 39 and 40.

Figure 41:
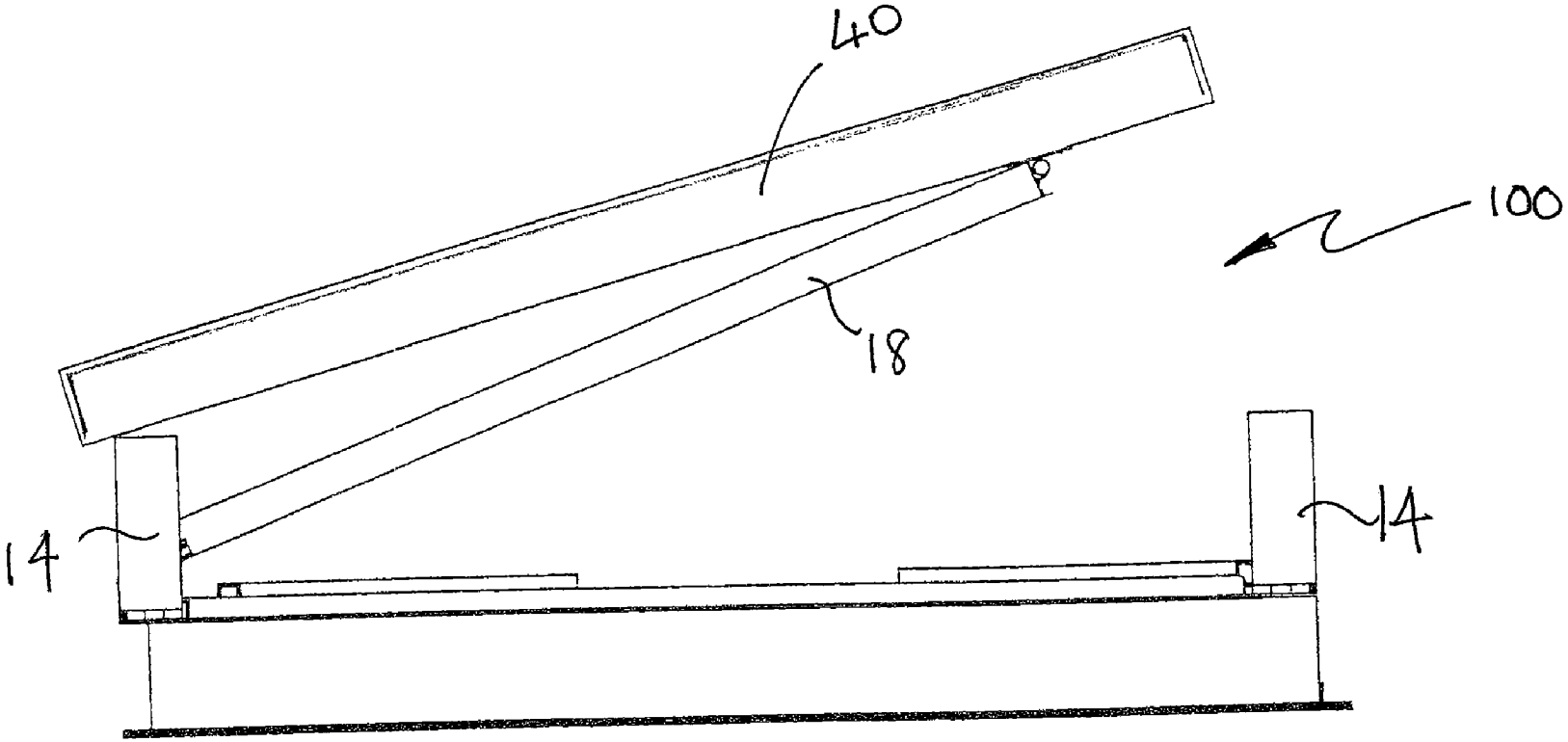
FIG. 41 is a side view showing the lid and rear panel being lowered into the base of the container.
Figure 42:
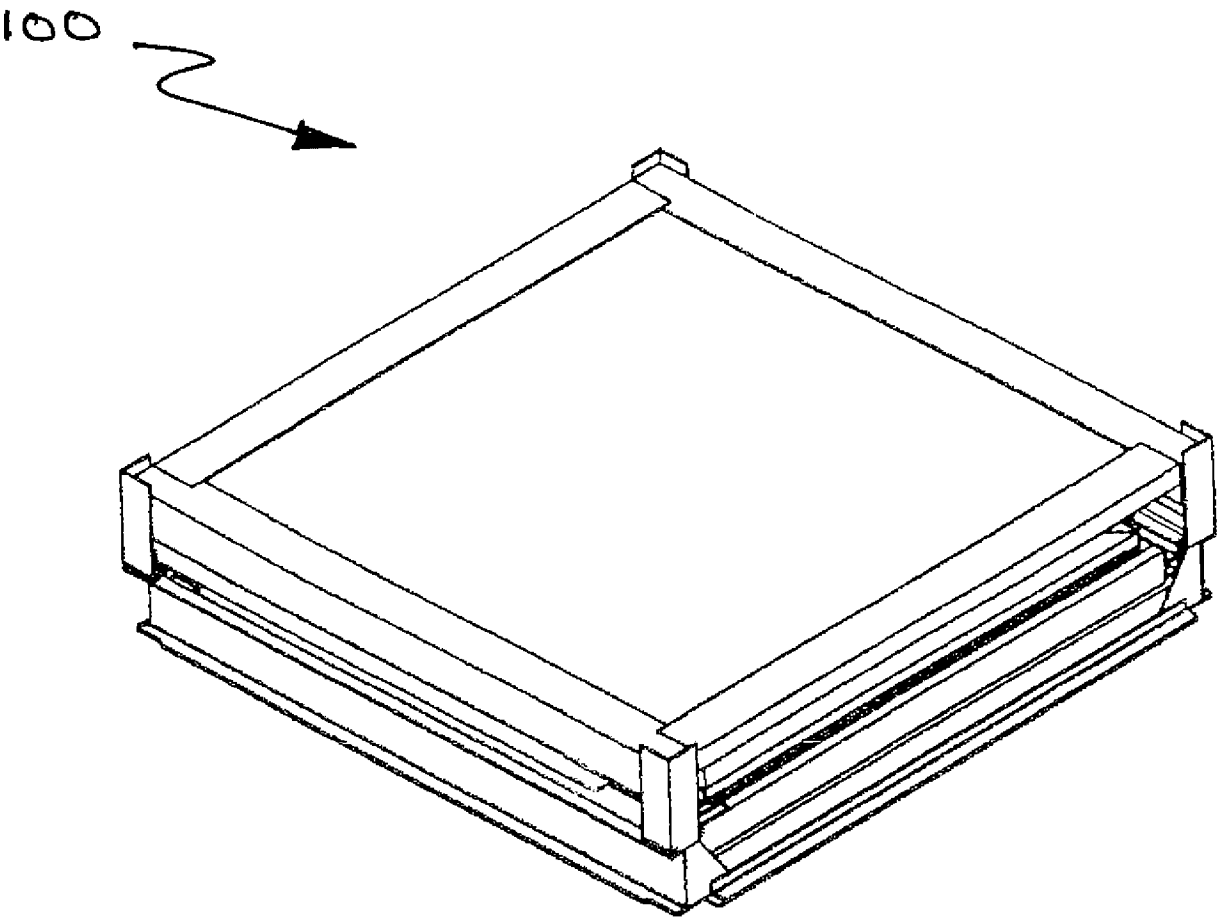
FIG. 42 is an isometric view elevation showing the container in its fully folded state.

Finally, with reference to FIGS. 41 and 42, the back panel 18 is lowered into the base on top of the folded side extension. The folded container shown in FIG. 42 may be stacked in the same manner as the first embodiment. In particular, the upper surface of the lid 40 is below the tops of the corner posts so that the folded containers can be stacked as shown in FIGS. 22 and 23 with the corners posts preventing the folded containers from sliding relative to one another. However, as discussed above, the corner posts are inessential and may be omitted. Five or six folded containers will fit in the volume occupied by a typical standard unit load device.

Erection of the container is the reverse of the folding procedure described above. It will be appreciated by persons skilled in the art that numerous variations and/or modifications may be made to the invention as shown in the specific embodiments without departing from the spirit or scope of the invention as broadly described. For example although a particular order of folding is described above, it will be appreciated that the order of the folding of the components of the container may be varied. The present embodiments are, therefore, to be considered in all respects as illustrative and not restrictive.

The invention claimed is:

1. A collapsible folding freight container for air transport, having an erected state and a collapsed or folded state, the container comprising:

a base;

a side panel mounted to the base such the side panel may be folded over the base;

an end panel mounted to the base such the end panel may be folded over the base;

a side extension assembly including a frame and a collapsible side extension, the side extension having an erected configuration and a collapsed configuration and wherein in the collapsed configuration the side extension and frame may be folded over the base; and a lid slidably mounted between two of the frame, the side panel and the end panel and being pivotable relative to the other of the two panels or frame, wherein when the end panel is folded over the base the lid locates above the other of the two panels or the frame.

2. A collapsible folding freight container as claimed in claim 1 wherein the side extension includes:

a pair of end panels which are pivotally mounted to opposed vertical sides of the frame;

a side extension lid; and side extension panels which are mounted to lower horizontal members of the frame and/or the side extension lid and/or each other.

3. A collapsible folding freight container as claimed in claim 2 wherein the side extension lid is hinged to the upper member of the frame, a first upper side extension panel, which is generally vertical in use when the container is erected, is hinged to the side extension lid, and wherein a sloping side wall panel, which is oriented at an angle between vertical and horizontal in use when the container is erected, is hinged to the lower horizontal member of the frame, and a side wall extension panel is hinged to the sloping side wall panel.

4. A collapsible folding freight container as claimed in claim 1 wherein in the collapsed configuration, any side extension components all locate inside the frame.

5. A collapsible folding freight container as claimed in claim 1 wherein the side extension is generally trapezoidal in cross-section.

6. A collapsible folding freight container as claimed in claim 2 wherein the end panels of the side extension define L shaped edges for supporting edges of the side panels.

7. A collapsible folding freight container as claimed in claim 1 wherein the lid is slidably mounted between the frame and the side panel and is pivotable relative to the back panel, wherein when the end panel is folded over the base, the lid locates directly above the back panel.

8. A collapsible folding freight container as claimed in claim 7 wherein the base defines upstanding corner posts and the side panel is mounted to the base by means of slideable hinges and can be lowered onto the upper surface of the base below the top of the corner posts.

9. A collapsible folding freight container as claimed in claim 8 wherein when collapsing the container, the side wall is lowered onto the base, the collapsed frame and side extension assembly locate on top of the side wall, the back wall locates on top of the side extension and frame and the lid locates on top of the back wall.

10. A collapsible folding freight container as claimed in claim 9 wherein in the collapsed state the lid lies below the top of the corner posts.

11. A collapsible folding freight container as claimed in claim 9 wherein a pair of spigots depend from the lid and slideably locate in channels defined near a top edge of the side panel and frame respectively and wherein a pair of recesses are defined in the top of the back panel which when the container is in the erected state are aligned with one of the channels to allow the spigots to be slid along the channels and into the recesses.

12. A collapsible folding freight container for air transport, having an erected state and a collapsed or folded state, the container comprising:

a base;

a side panel mounted to the base;

an end panel mounted to the base;

a side extension assembly including a frame and a collapsible side extension, the side extension having an erected configuration and a collapsed configuration and wherein in the collapsed configuration the side extension and frame may be folded over the base; and a lid which in the erected state locates on an may be supported by the side panel, end panel and the frame; and wherein the side extension assembly further comprises;

a pair of end panels which are pivotally mounted to opposed vertical sides of the frame;

a side extension lid; and side extension panels which are mounted to lower horizontal members of the frame and/or the side extension lid and/or each other, the arrangement being such that in the collapsed state the end panels and side extension lid and panels locate within the frame.

13. A collapsible folding freight container as claimed in claim 12 wherein the side extension includes:

a pair of end panels which are pivotally mounted to opposed vertical sides of the frame;

a side extension lid pivotally mounted to an upper horizontal member of the frame; and side extension panels which are mounted to lower horizontal members of the frame and/or the side extension lid and/or each other.

14. A collapsible folding freight container as claimed in claim 13 wherein the side extension lid is hinged to the upper member of the frame, a first upper side extension panel, which is generally vertical in use when the container is erected, is hinged to the side extension lid, and wherein a sloping side wall panel, which is oriented at an angle between vertical and horizontal in use when the container is erected is hinged to the lower horizontal member of the frame, and a side wall extension panel is hinged to the sloping side wall panel.

15. A collapsible folding freight container as claimed in claim 12 wherein the side extension is generally trapezoidal in cross-section.

16. A collapsible folding freight container for air transport, having an erected state and a collapsed or folded state, the container comprising:

a base;

a side panel mounted to the base such the side panel may be folded over the base;

an end panel mounted to the base such the end panel may be folded over the base;

a side extension assembly including a frame and a collapsible side extension, the side extension having an erected configuration and a collapsed configuration and wherein in the collapsed configuration the side extension and frame may be folded over the base, the side extension including a side extension lid;

a lid slidably mounted between two of the frame, the side panel and the end panel and being pivotable relative to the other of the two panels or frame, wherein when the end panel is folded over the base the lid locates above the other of the two panels or the frame; and wherein the lid and the side extension lid are configured such that the side extension lid panel may be retracted or slid into the lid.

17. A collapsible folding freight container as claimed in claim 16 wherein the frame is includes two opposed sides which can be shortened to reduce the height of the frame.

18. A collapsible folding freight container as claimed in claim 16 wherein the side extension further includes:

a pair of end panels which are pivotally mounted to opposed vertical sides of the frame;

side extension panels which are mounted to lower horizontal members of the frame and/or the side extension lid and/or each other and wherein the two opposed sides of the frame each comprise a first portion and a second portion linked by a connection portion and wherein the side extension panels are mounted to the second portions of the opposed sides of the frame.

* * * * *